US005802747A

United States Patent [19]

Nojima

[11] Patent Number: 5,802,747

[45] Date of Patent: Sep. 8, 1998

[54] CRUSHER

[75] Inventor: Akihiko Nojima, deceased, late of Osaka-fu, Japan, by Chiyoko Nojima, executor

[73] Assignee: Jacty Engineering Co., Ltd., Oosaka, Japan

[21] Appl. No.: 812,289

[22] Filed: Mar. 6, 1997

[30] Foreign Application Priority Data

Mar. 29, 1996 [JP] Japan ..... 8-076406

[51] Int. Cl.[6] ..... E02F 3/40; B02C 1/02

[52] U.S. Cl. ..... 37/403; 37/319; 241/27; 299/67

[58] Field of Search ..... 37/303, 319, 403, 37/404, 406, 466, 443, 447, 903; 241/101.7, 69, 27, 73, 189.1, 191; 414/737, 790; 299/67; 91/518, 531

[56] References Cited

U.S. PATENT DOCUMENTS

| | | | |
|---|---|---|---|
| 3,946,955 | 3/1976 | Bond . | |
| 3,959,897 | 6/1976 | May | 37/319 |
| 5,237,908 | 8/1993 | Kropp | 81/518 |
| 5,405,092 | 4/1995 | Jonninen | 37/403 X |
| 5,485,689 | 1/1996 | Jonninen | 37/406 X |
| 5,619,811 | 4/1997 | Yrjölä | 37/903 X |
| 5,628,611 | 5/1997 | Ito et al. | 414/737 |

FOREIGN PATENT DOCUMENTS

| | | |
|---|---|---|
| 1164216 | 9/1964 | Germany . |
| 3716895 | 12/1987 | Germany . |

*Primary Examiner*—Michael J. Carone
*Assistant Examiner*—Robert Pezzuto
*Attorney, Agent, or Firm*—Kanesaka & Takeuchi

[57] ABSTRACT

A driving device of a jaw crusher of attachment type comprising a hydraulic cylinder having a rod connected with a movable member; a hydraulic source provided on a body of a hydraulic excavator having a mobile travel device; and a control mechanism for supplying a hydraulic pressure to the hydraulic cylinder so that the rod is extended and retracted reciprocatively and detecting a hydraulic pressure at an extension side of the hydraulic cylinder and a retraction side thereof, thus switching extension and retraction operations of the rod to each other when the hydraulic pressure at the extension side of the hydraulic cylinder or the retraction side thereof exceeds a predetermined value.

7 Claims, 22 Drawing Sheets

CRUSHER

BACKGROUND THE INVENTION

1. Field of the Invention

The present invention relates to a crusher for crushing an object such as stones, concrete materials, and the like generated in dismantling buildings in general. More particularly, the present invention relates to a crusher (what is called a jaw-type crusher) which is attached detachably on an arm of a hydraulic shovel, crushes shoveled objects and discharges crushed pieces, and disperses the crushed pieces to lay them on the ground.

2. Description of Related Art

Various types of crushers of attachment type which can be installed at the front end of an arm of a power shovel such as a breaking machine for dividing object to small pieces (what is called a kowariki) or a reinforcing bar-cutting machine have been proposed.

In crushers of attachment type, a hydraulic cylinder is driven, with a hydraulic pump of a power shovel body used as a hydraulic source so as to approach a movable member to a fixed member and retract it from the fixed member. The hydraulic cylinder is controlled by operating a lever, a pedal, and a push button-type switch installed proximately to a driver's seat of the power shovel body, each time a rod is extended or retracted. That is, the operator is required to operate the lever and the like for each extension operation of the rod of the hydraulic cylinder so as to allow a crusher to perform a closing operation and for each retraction operation of the rod so as to allow the crusher to perform an opening operation.

In the crusher, when the operator has started to extend the rod by operating the lever and the like so as to perform the closing operation, the rod cannot be retracted unless the operator operates the lever again. Thus, even when a crushing operation or a cutting operation has not been completed by one-time extension of the rod, an object to be crushed or reinforcing bars remains sandwiched between the movable member and the fixed member, with an excessive force being applied to the movable member to be driven by the hydraulic cylinder unless the operator operates the lever and the like. When the opening and closing operation is repeatedly performed, the operator is required to operate the lever and the like repeatedly, thus having inconvenience in operability and workability.

In order to overcome the above-described problem, a crusher of attachment type is disclosed in Laid-Open Japanese Patent Publication No. 5-39802, as shown in FIGS. 23 (A) and 23 (B). The crusher crushes an object 4 sandwiched between the movable member 2 and the fixed member 3. The driving device 6 has the control mechanism 5 comprising the hydraulic cylinder 1 connected with the movable arm 2; the selector valve 7 of four-port three-position type which is operated by an operator who operates the lever and the like; the pilot selector valve 8 consisting of the electromagnetic selector valve of three-port two-position type; the pressure detection device 9; the switch 11; the pulse generator 12; and the electromagnetic driver 13.

In the crusher, when the operator switches the selector valve 7 to the position (X), the switch 11 is changed simultaneously, and the pilot selector valve 8 is switched to the position (Y), thus constituting a differential circuit at the piston 14 side and the rod 16 side. Consequently, the rod 16 extends to allow the movable arm 2 to perform a closing operation. When the movable arm 2 contacts the object 4, the hydraulic pressure at the piston 14 side of the hydraulic cylinder 1 rises. Upon detection of the rise in the hydraulic pressure, the pressure detection device 9 is turned off. At the rise of pulses outputted from the pulse generator 12, the electromagnetic driver 13 is not driven, whereas at the fall of pulses outputted therefrom, the electromagnetic driver 13 is driven. As a result, the pilot selector valve 8 is switched to the position (Y) and the position (Z) alternately. Thus, in the state in which the object 4 is sandwiched between the movable arm 2 and the fixed arm 3, strong and weak vibrations are generated by the driving force for driving the movable arm 2 to the closed position side. Although an excessive force is not kept to be applied to the movable arm 2, the operator is required to operate the selector valve 7 repeatedly in opening and closing the movable arm 2 continuously, thus having inconvenience in operability and workability.

SUMMARY OF THE INVENTION

The present invention has been made to overcome the above-described conventional problem. It is accordingly an object of the present invention to provide a jaw-type crusher of attachment type capable of repeatedly performing opening and closing operations automatically without a driver's manual operation.

It is another object of the present invention to allow the jaw-type crusher to perform a crushing operation with a high efficiency by improving an operation locus of a movable member which approaches to a fixed member and moves away therefrom.

It is still another object of the present invention to manufacture a compact and light jaw-type crusher by reducing the number of component parts.

It is a further object of the present invention to prevent a discharge opening from being clogged with earth and sand.

In order to achieve the above objects, according to the present invention, there is provided a jaw-type crusher to be removably installed on an arm of a hydraulic excavator having a travel device through a bracket projecting from a frame thereof. The frame accommodates a fixed member and a movable member confronting the fixed member; a driving device installed in the frame allows the movable member to approach the fixed member and retreat the movable member therefrom; crushing plates installed on the fixed member confronting crushing plates installed on the movable member crush an object; and crushed pieces are discharged from an opening formed at a lower end of the frame.

The driving device comprises a hydraulic cylinder which is operated by a hydraulic source provided on a body of the hydraulic excavator and has a rod connected with the movable member; and a control mechanism for detecting a hydraulic pressure at an extension side of the hydraulic cylinder and a retraction side thereof and switching extension and retraction operations of the rod to each other when the hydraulic pressure at the extension side of the hydraulic cylinder or the retraction side thereof exceeds a predetermined value.

In the crusher having the construction in above described, when the hydraulic pressure at the extension side of the hydraulic cylinder or the retraction side thereof exceed a predetermined value, the extension operation and the retraction operation of the rod are switched to each other. Therefore, when the movable member has started its operation, it approaches the fixed member and retreats therefrom automatically. Therefore, it is not necessary for an operator to operate the lever and the like, each time the movable member approaches the fixed member and retreats therefrom. That is, the crusher has a high operability and crushing performance. When an object is sandwiched between the movable member and the fixed member, the hydraulic pressure of the hydraulic cylinder rises above the predetermined value. As a result, the rod of the hydraulic cylinder is switched from the extension operation to the retraction operation. Therefore, an excessive force can be prevented from being applied to the movable member.

The driving device comprises a first pressure detection port to which a hydraulic pressure of a rod side of the hydraulic cylinder is applied; a second pressure detection port to which a hydraulic pressure of a piston side of the hydraulic cylinder is applied; and a spring center type selector valve having first and second springs which specify a required value of the hydraulic pressure at the extension side of the hydraulic cylinder and the retraction side thereof and is switched when a difference between the hydraulic pressure applied to the first pressure detection port and that applied to the second pressure detection port becomes higher than an urging force of the first spring and that of the second spring.

In this construction, the hydraulic pressure at which the extension operation and the retraction operation of the rod is reversed to each other can be specified by the urging force of the first and second springs.

The urging force of the first spring and that of the second spring are adjustable.

In this construction, the hydraulic pressure for starting the switching of the extension operation of the rod to the retraction operation thereof and vice versa can be set to an appropriate value depending on the kind of objects to be crushed, the strength of the movable member, and that of the fixed member. Accordingly, the reciprocating motion of the movable member can be reliably accomplished. In addition, when an object sandwiched between the movable member and the fixed member, the switching of the extension operation of the rod can be reliably switched to the retraction operation.

Further, the rod of the hydraulic cylinder is rotatably connected with the movable member; a supporting arm projects downward from a rear surface of the movable member; a lower end of the supporting arm is rotatably connected with a frame; the movable member is rotated in an elliptic shape owing to an operation of the rod of the hydraulic cylinder so that the movable member approaches toward the fixed member while the movable member is moving downward in the elliptic shape, thus crushing the object sandwiched between the movable member and the fixed member. A supporting point of the supporting arm to the frame is located below the rod of the hydraulic cylinder when the rod has extended to the maximum.

In this construction, the lower end of the supporting arm projecting from the rear surface (opposite to the surface thereof confronting the fixed member) of the movable member is rotatably connected with the frame; the supporting point of the supporting arm is located below the frame; and the hydraulic cylinder, the rod of which is connected with approximately the center of the rear surface of the movable member is rotatably installed on the frame. This construction allows the movable member to approach to the fixed member while the movable member is moving downward by reciprocating approximately the center of the movable member by means of the hydraulic cylinder and retreat the movable member from the fixed member while the movable member is moving upward. In particular, because the movable member is moved downward toward the fixed member, a pressing force is applied to an object introduced into the space between the fixed member and the movable member, and the object is pressed out from the discharge port at the lower end of the frame, with the crushing plates installed on the fixed member and the movable member crushing the object.

A plurality of crushing plates are installed lengthwise side by side on the fixed member and the movable member: and an adjusting plate for adjusting a size of an object to be discharged from the lower end of the frame is removably mounted between the lowermost crushing plates installed on the movable member and the fixed member respectively.

The adjusting plate allows the size of an object to be discharged from the jaw crusher to be adjusted to a desired size. For example, when an object is required to be crushed into comparatively large pieces, a thin adjusting plate is mounted on the fixed member, whereas when the object is required to be crushed into very small pieces, a plurality of thick adjusting plates is mounted thereon by piling them one on the other so as to reduce the interval between the fixed member and the movable member. When the adjusting plate is mounted on the movable member, the degree of the hydraulic pressure is required to be great. Thus, preferably, adjusting plate is mounted on the fixed member.

Preferably, a plurality of openings is formed in the shape of a lattice at an end of an object-introducing side of the frame. This construction allows earth and sand to drop from the holes forming the shape of a lattice even though earth and sand are mixed with an object to be crushed when the object is introduced into the frame. Thus, earth and sand can be prevented from being supplied to the space between the fixed member and the movable member.

A hopper is installed on an upper part of the frame so as to introduce the object through an upper opening of the frame into a space between the fixed member and the movable member.

Owing to the provision of the hopper, a great amount of objects can be introduced into the frame and crushed efficiently, and crushed pieces can be discharged from the frame.

Further, a small-diameter passage is formed on a front end of a piston at a rod connection side or on a plunger connecting the front end of the piston and the rod with each other, wherein when the piston approaches a stroke end at the extension side thereof, a flow rate of lubricating oil flowing through a lubricating oil entrance/exit formed in the cylinder is reduced through the small-diameter passage to allow the piston to collide a cylinder head with a weak force at the stroke end of the piston. Because this type of the hydraulic cylinder allows vibrations and noises to be generated in a small degree.

Furthermore, an electromagnet is installed on an outer surface of the frame to attract objects thereto by means of a magnetic force. The electromagnet installed on the outer surface of the frame attracts small metallic objects contained in an object to be crushed. Further, when the metallic objects have reached a position where the metallic objects are collected, the electromagnet is unenergized to remove them therefrom.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 2 (B) is a plan view showing the crusher according to the first embodiment of the present invention;

FIG. 3 (B) is a plan view partly broken away showing the crusher according to the first embodiment of the present invention;

FIG. 5 (B) is side view showing the control mechanism of the first embodiment;

FIG. 5 (C) is front view showing the control mechanism of the first embodiment;

FIG. 10 (B) is a plan view partly broken away showing the crusher according to the second embodiment of the present invention;

FIG. 18 (B) is an enlarged sectional view of showing a part of the FIG. 18 (A);

FIG. 23 (B) is a hydraulic circuit diagram of a driving device of the conventional crusher.

DESCRIPTION OF THE PREFERRED EMBODIMENTS

A jaw-type crusher according to the embodiments of the present invention will be described below with reference to the drawings.

Figure 1:
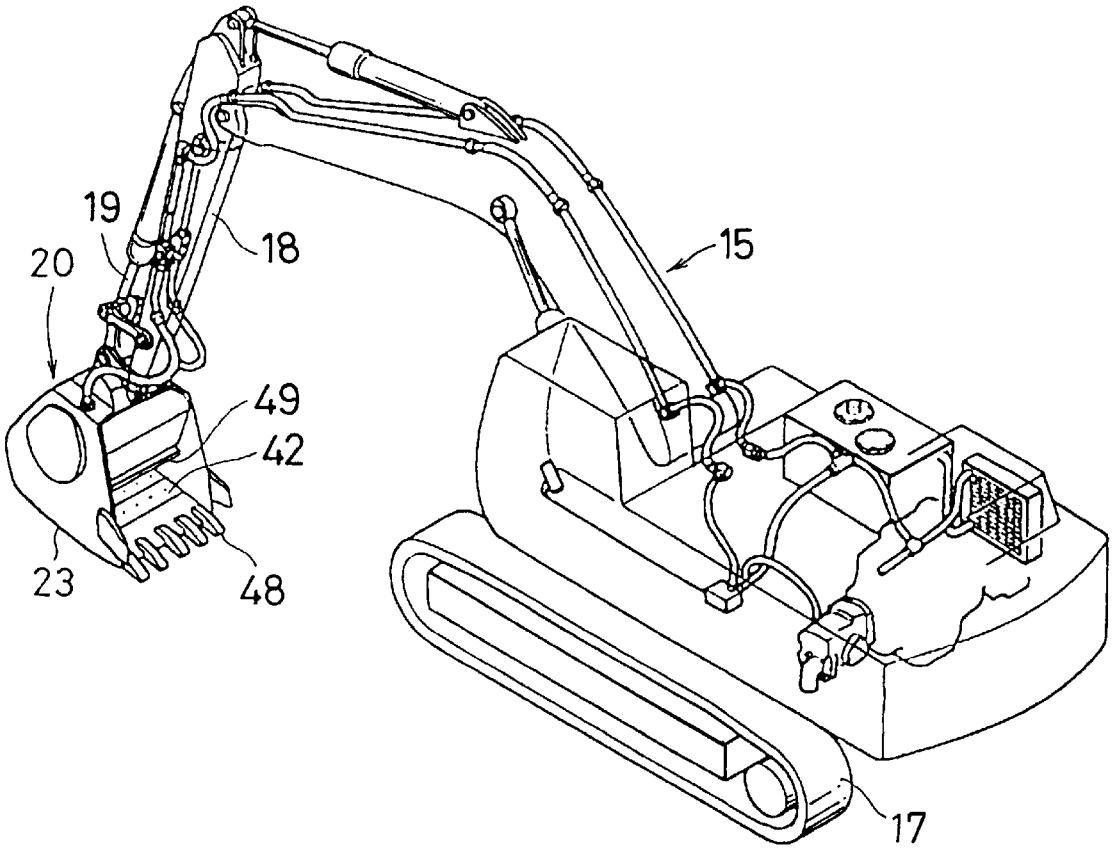
FIG. 1 is a perspective view showing a state in which a jaw-type crusher according to a first embodiment of the present invention has been installed on a power shovel.

A jaw-type crusher 20 of attachment type according to the first embodiment shown in FIGS. 1 through 9 is removably installed on an arm 18 and the front end of a link 19 of a power shovel 15 having a caterpillar-type travel device 17, as shown in FIG. 1.

The crusher 20 comprises a frame 23 accommodating a crushing mechanism 21 and a driving device 22; and a bracket 24 to be connected with the arm 18 and a link rod 19 of the power shovel 15.

Figure 2A:
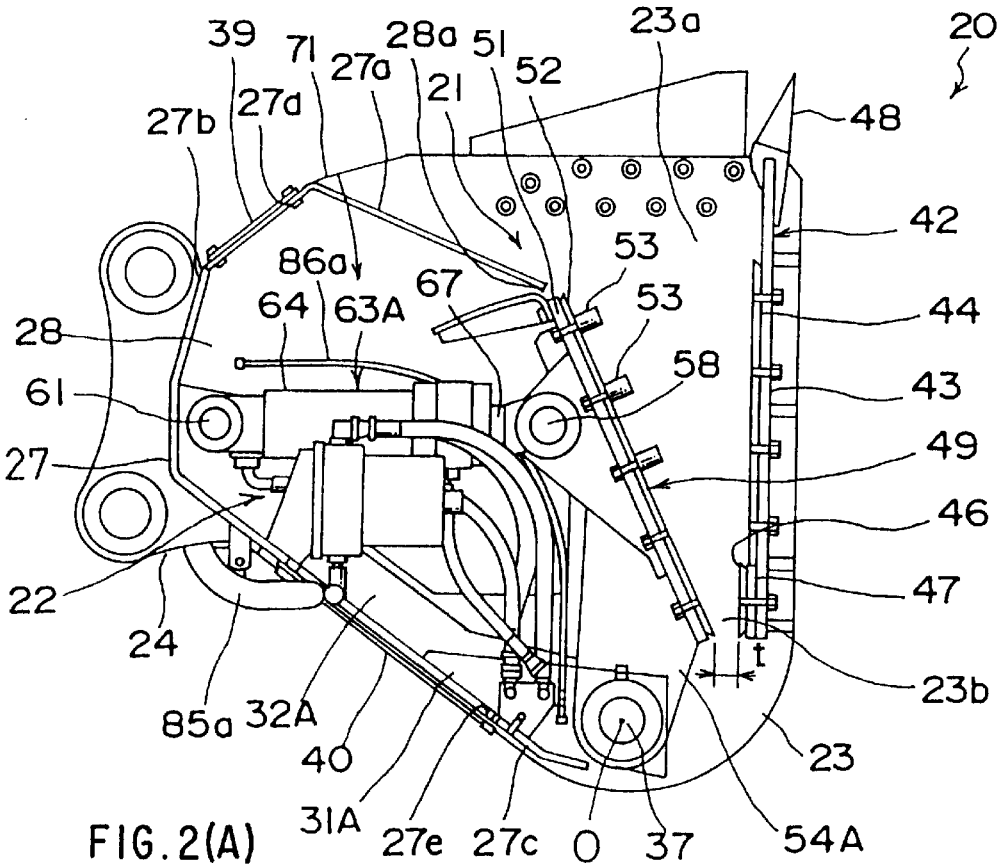
FIG. 2 (A) is a side view showing a state in which one of side plates of the crusher according to the first embodiment of the present invention has been removed.
Figure 2B:
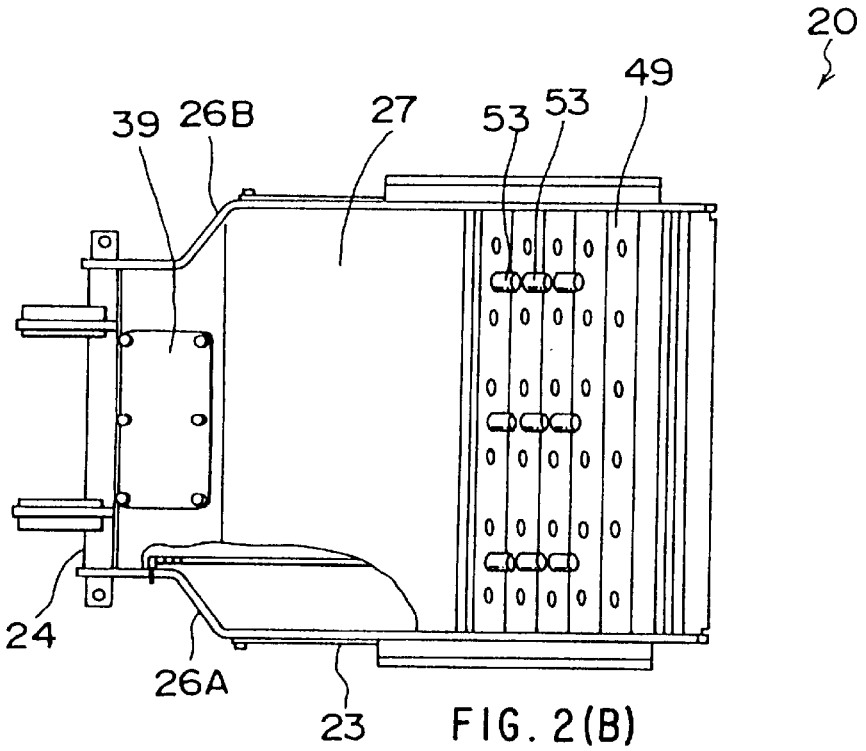

As shown in FIGS. 2 (B) and 3 (A), the frame 23 has a pair of right and left side plates 26A and 26B spaced at a predetermined interval; and a cover 27 connecting the side plates 26A and 26B to each other. The cover 27 comprises an upper side portion 27*a* closing the upper end of the rear side of the space surrounded with the side plates 26A and 26B; a rear side portion 27*b* closing the rear end of the space surrounded with the side plates 26A and 26B; and a bottom side portion 27*c* closing the lower end of the space surrounded with the side plates 26A and 26B. An accommodating chamber 28 accommodating the driving device 22 is situated in the rear half of the space surrounded with the cover 27 and the side plates 26A and 26B.

Figure 3A:
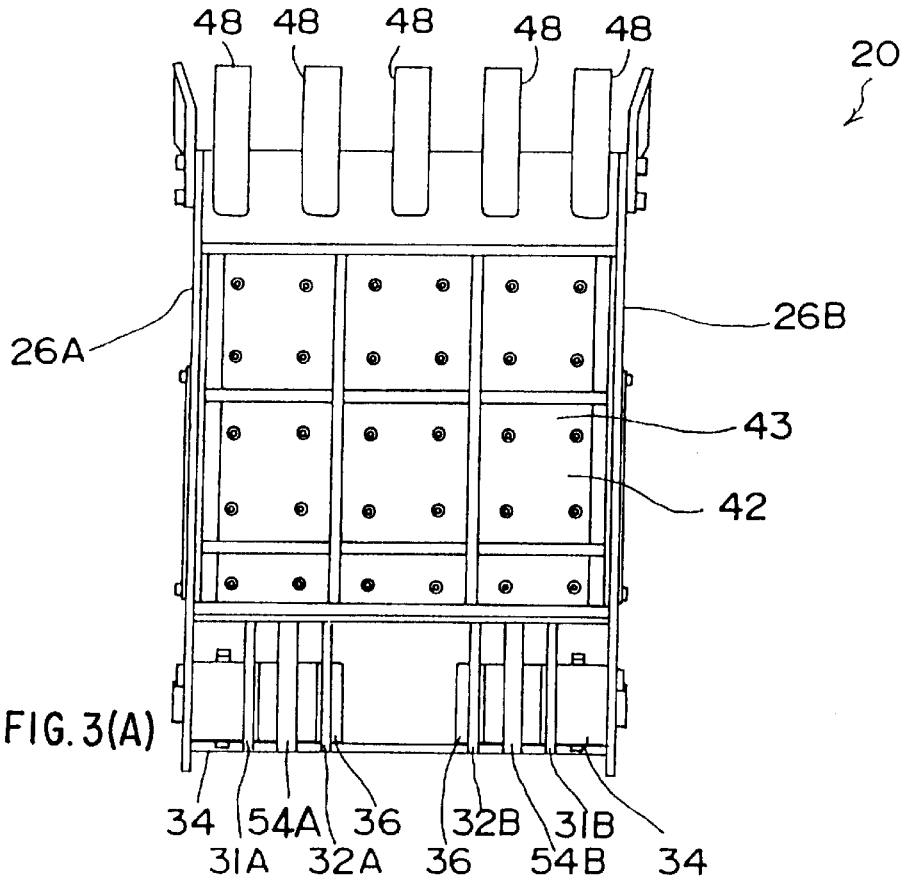
FIG. 3 (A) is a front view showing the crusher according to the first embodiment of the present invention.
Figure 3B:
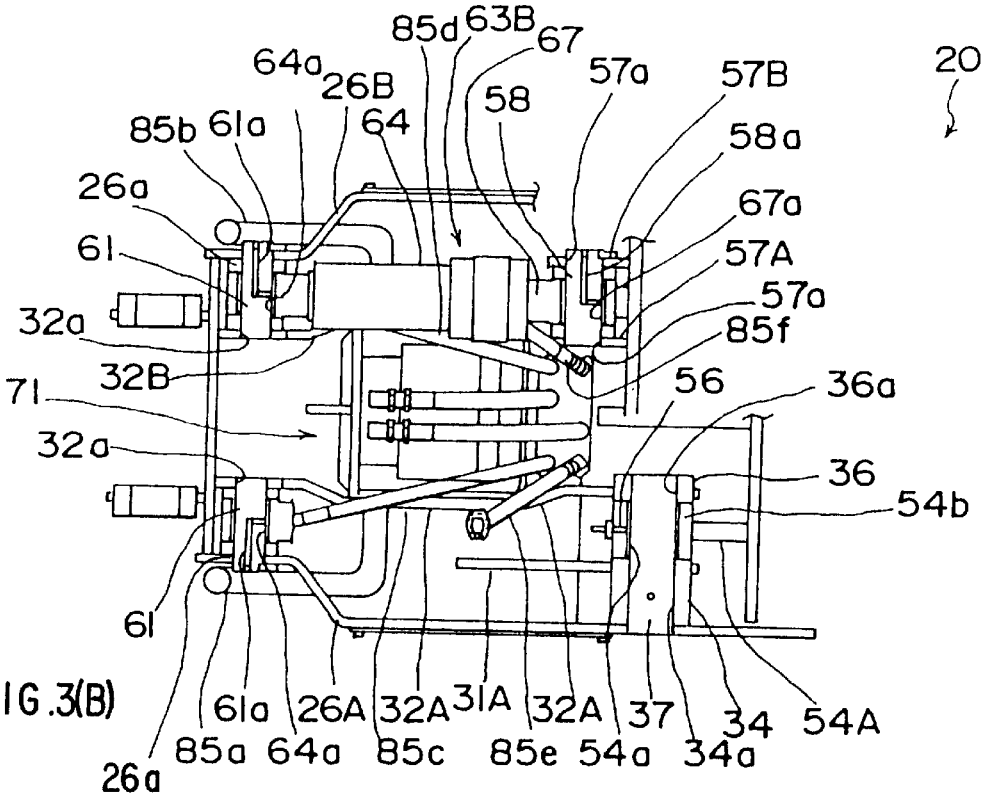

As shown in FIG. 3 (B), first ribs 31A and 31B and second ribs 32A and 32B all parallel with the side plates 26A and 26B are formed at the lower end of the cover 27. As shown in FIGS. 3 (A) and 3 (B), a column 34 is formed between the side plate 26A and the first rib 31A and between the side plate 26B and the first rib 31B. A column 36 is fixed to the front end of each of the second ribs 32A and 32B. A supporting shaft 37 is nonrotatably fixed to a shaft hole 34*a* formed on the column 34 and a shaft hole 36*a* formed on the column 36 by means of pins.

As shown in FIG. 2 (A) an opening portion 27*d* for maintenance and an opening portion 27*e* for maintenance are formed on the upper side portion 27*a* of the cover 27 and the bottom side portion 27*c* thereof, respectively. The opening portions 27*d* and 27*e* are closed with covering plates 39 and 40, respectively fixed to the cover 27 with bolts.

A fixed member 42 is fixed to the frame 23 at its front side.

Figure 4:
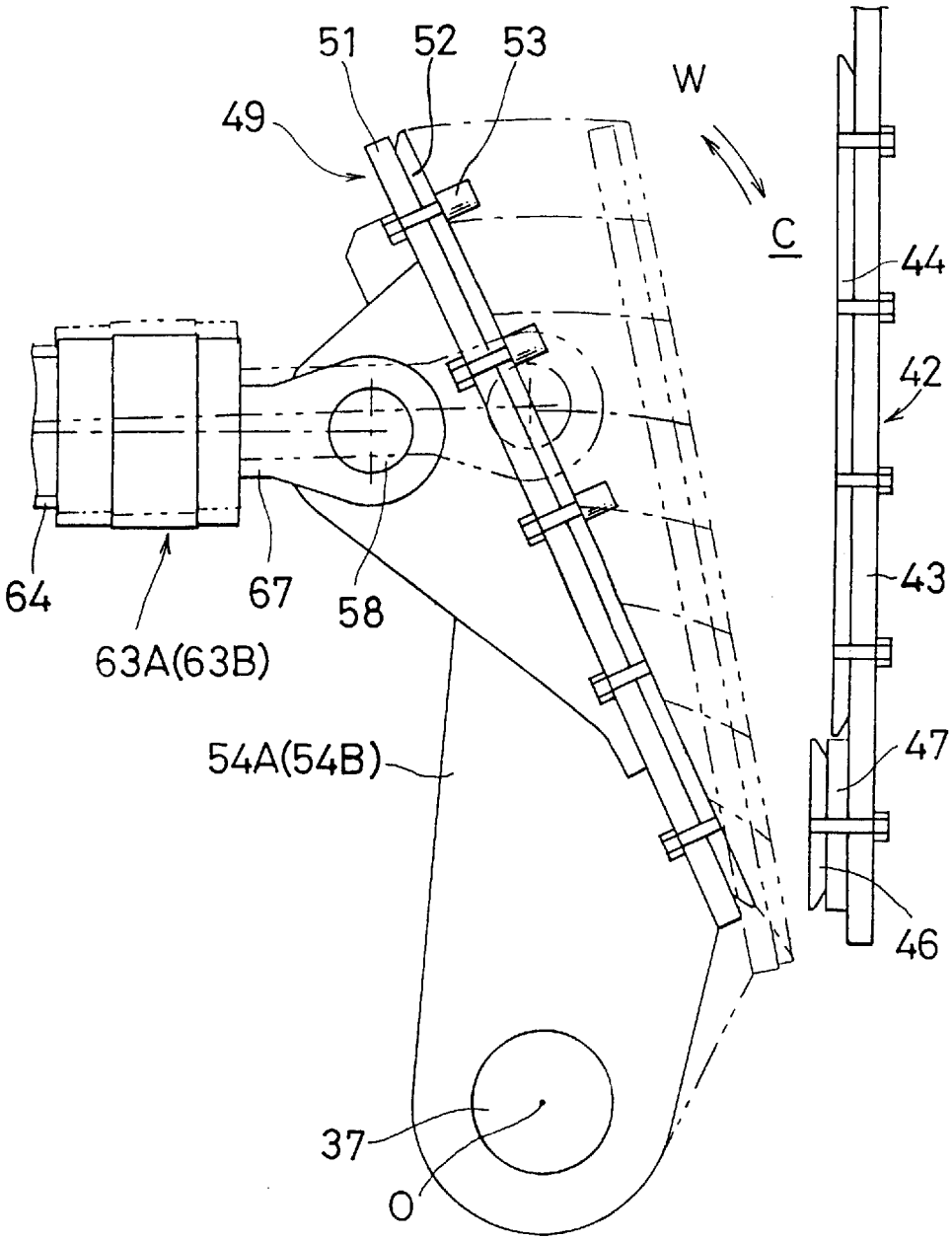
FIG. 4 is an enlarged view showing main parts of the jaw-type crusher according to the first embodiment of the present invention.

Referring to FIG. 4, in particular, a fixed member 42 comprises a plurality of crushing plate 44 fixed, with bolts, to one surface of a flat base plate 43, the ends of which are fixed to the side plates 26A and 26B. A plurality of crushing plates 46 is fixed to the lower end of the base plate 43 through an adjusting plate 47 with a bolt. The adjusting plate 47 having a thickness different from that of the crushing plate 44 serves as a means for adjusting the clearance (t) of a discharge port 23*b*.

In the right-to-left direction of the crusher 20, a plurality of claws 48 is arranged at regular intervals on the upper end of the fixed member 42, as shown in FIGS. 1 and 2.

A movable member 49 confronting the fixed member 42 is provided in the opening portion 28*a* located at the front side of the accommodating chamber 28. As shown in FIG. 4 in detail, a plurality of crushing plate 52 is fixed to one surface of a base plate 51 of the movable member 49 with bolts in such a manner that the crushing plates 52 confronts the fixed member 42. A plurality of crushing projections 53 for increasing the crushing force of the movable member 49 is formed on the upper half part of the crushing plates 52. A pair of supporting arms 54A and 54B projects downward from the other surface of the substrate 51. As shown in FIG. 3 (B), a column 54*b* having a shaft-receiving hole 54*a* formed therein is provided at the front end of each of the supporting arms 54A and 54B. The supporting shaft 37 fixed to the front end of the bottom side portion 27*c* is rotatably inserted into the shaft-receiving hole 54*a* so that the supporting shaft 37 supports the lower side of the movable member 49 rotatably. A supply path 56 shown in FIG. 3 (B) supplies the shaft-receiving hole 54*a* with lubricating oil.

A pair of connection portions 57A and 57B spaced at a predetermined interval is formed on the right and left ends of the upper side of the surface, of the movable member 49, opposite to the surface thereof confronting the fixed member 42. As shown in FIG. 3 (B), a supporting shaft 58 is fixed to a shaft-receiving hole 57*a* formed on the connection portions 57A and 57B. The supporting shaft 58 is rotatably inserted into a shaft-receiving hole 67*a* a formed at the front end of a rod 67 of each of a pair of hydraulic cylinders 63A and 63B accommodated in the accommodating chamber 28. The hydraulic cylinders 63A and 63B will be described later. The supporting shaft 58 is provided with a passage 58*a* for supplying the shaft-receiving hole 67*a* with lubricating oil.

In the accommodating chamber 28, the lower side of the movable member 49 is rotatably supported by the supporting shaft 37 through the supporting arms 54A and 54B. The upper side of the movable member 49 is connected with the rod 67 of each of the hydraulic cylinders 63A and 63B. As shown in FIGS. 2 (A) and 4, the supporting point (O) of the supporting shaft 37 is located immediately below the rod 67 of each of the hydraulic cylinders 63A and 63B when the rod 67 is extended to the maximum (shown by one-dot chain line in FIG. 4), whereas the supporting point (O) of the supporting shaft 37 is located forward from the rod 67 when the rod 67 is retracted to the maximum. Thus, as shown by solid lines in FIG. 4, at the rod-retracted position, the movable member 49 inclines rearward. Accordingly, as shown by the arrow (W) of FIG. 4, when the rod 67 moves forward and backward repeatedly, the movable member 49 approaches the fixed member 42 and retreats therefrom, with the supporting shaft 37 at its supporting point (O). As shown in FIGS. 3 (B), a supporting shaft 61 is nonrotatably fixed to a shaft-receiving hole 32*a* formed on each of the second ribs 32A and 32B and a shaft-receiving hole 26*a* formed on each of the side plates 26A and 26B and rotatably inserted into a shaft-receiving hole 64*a* formed at the rear end of a cylinder 64 of each of the hydraulic cylinders 63A and 63B. The supporting shaft 61 is provided with a supply path 61*a* for supplying the shaft-receiving hole 64*a* with lubricating oil.

Figure 5A:
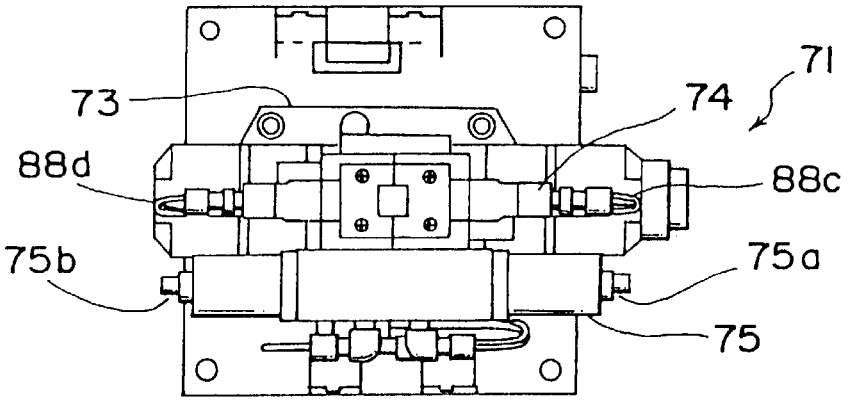
FIG. 5 (A) is plan view showing a control mechanism of the first embodiment.
Figure 5B:
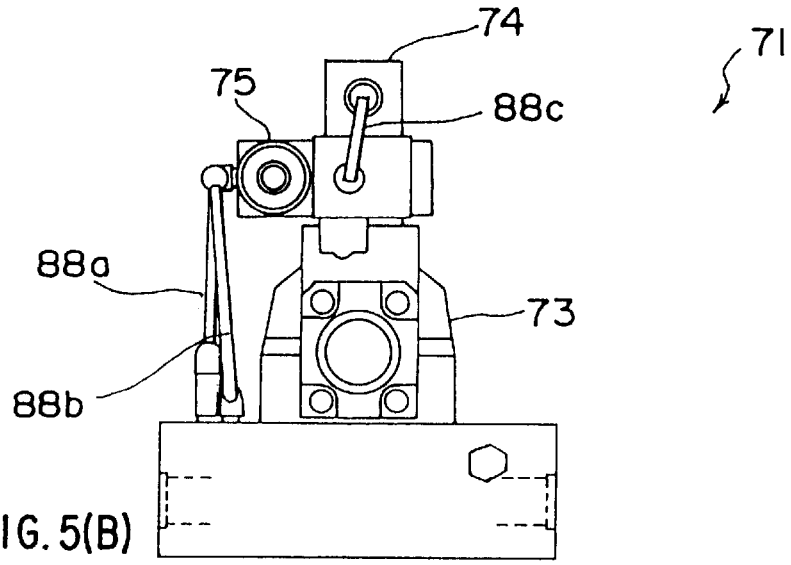
Figure 5C:
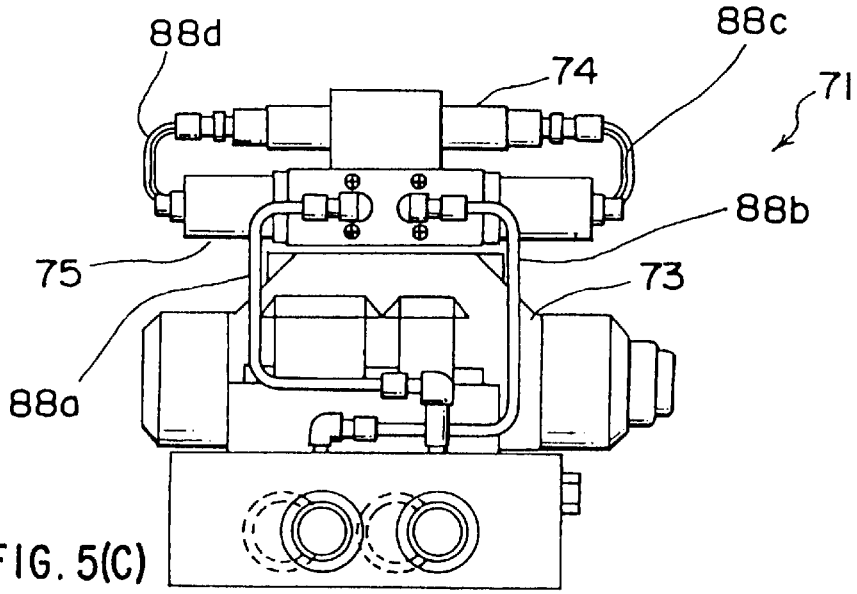

The accommodating chamber 28 accommodates a control mechanism 71 for controlling the operation of the hydraulic cylinders 63A and 63B. The control mechanism 71 has a construction, as shown in FIGS. 5 (A), 5 (B), and 5 (C). The hydraulic circuit of the control mechanism 71 is as shown in FIG. 6.

Figure 6:
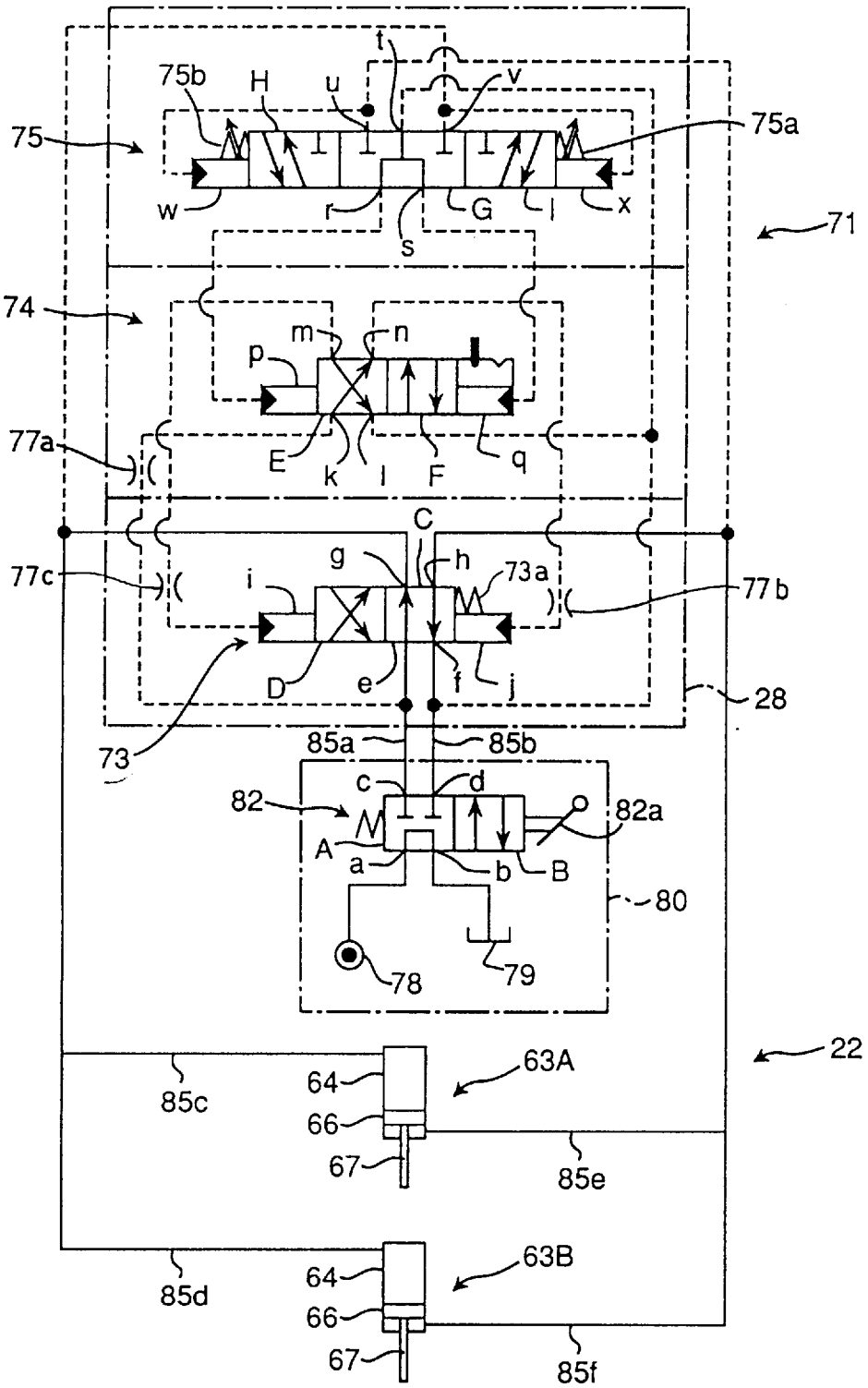
FIG. 6 is a hydraulic circuit diagram of a driving device.

As shown in FIGS. 5 and 6, the control mechanism 71 has a main vale 73, a first pilot valve 74, a second pilot valve 75, and a throttle 77 (shown in FIG. 6). The body 80 of the power shovel 15 has a hydraulic pump 78 serving as the hydraulic source, a reservoir 79, and a main selector valve 82.

The main selector valve 82 is of four-port two-position type.

Of the four ports of the main selector valve 82, a first port (a) is connected with the hydraulic pump 78. A second port (b) is connected with the reservoir 79. A third port (c) is connected with a port (e) of the main valve 73 and a port (k) of the first pilot valve 74. A fourth port (d) is connected with a port (f) of the main valve 73, a port (l) of the first pilot valve 74, and a port (t) of the second pilot valve 75.

When an operation lever 82*a* provided proximately to a driver's seat of the power shovel 15 is not operated, the main selector valve 82 is at a position (A). As a result, the port (a) is connected with the port (b), whereas the ports (c) and (d) are closed. When a driver operates the operation lever 82*a*, the main selector valve 82 is switched to a position B. As a result, the port (a) is connected with the port (c) and the port (d) is connected with the port (b).

The main vale 73 is a selector valve of spring off-set type and four-port two-position type.

Of the four ports of the main valve 73, a first port (e) is connected with the port (c) of the main selector valve 82 and the port (k) of the first pilot valve 74. A second port (f) is connected with the port (d) of the main selector valve 82, the port (l) of the first pilot valve 74, and the port (t) of the second pilot valve 75. A third port (g) is connected with the piston side of the hydraulic cylinders 63A and 63B and a port (v) of the second pilot valve 75. A fourth port (h) is connected with the rod side of the hydraulic cylinders 63A and 63B and a port (u) of the second pilot valve 75.

The main valve 73 has pressure detection ports (i) and (j). When the difference between a hydraulic pressure (pilot pressure) applied to the pressure detection port (i) and that applied to the pressure detection port (j) is smaller than the urging force of a spring 73*a*, the urging force of the spring 73*a* forces the main valve 73 to be located at a position (C). At the position (C), the port (e) and the port (g) are connected with each other and the port (f) and the port (h) are connected with each other. On the other hand, when the difference between the pilot pressure applied to the pressure detection port (i) and that applied to the pressure detection port (j) is greater than the urging force of the spring 73*a*, the main valve 73 is switched from the position (C) to a position (D). As a result, the port (e) and the port (h) are connected with each other, and the port (f) and the port (g) are connected with each other.

The first pilot valve 74 is a four-port two-position type and a selector valve of detent type which holds a switched position even when the pilot pressure is not applied thereto.

Of the four ports of the first pilot valve 74, the first port (k) is connected with the port (c) of the main selector valve 82 and the port (e) of the main valve 73. The second port (l) is connected with the port (d) of the main selector valve 82, the port (f) of the main valve 73, and the port (t) of the second pilot valve 75. A third port (m) is connected with the pressure detection port (i) of the main valve 73. A fourth port (n) is connected with the pressure detection port (j) of the main valve 73.

The position of the first pilot valve 74 is switched to a position (E) when the pilot pressure of a pressure detection port (p) is greater than that of a pressure detection port (q) by more than a predetermined value. As a result, the port (k) and the port (n) are connected with each other, and the port (l) and the port (m) are connected with each other. On the other hand, the first pilot valve 74 is switched to a position (F) when the pilot pressure of the pressure detection port (q) is greater than that of the pressure detection port (p) by more than a predetermined value. As a result, the port (k) and the port (m) are connected with each other, and the port (l) and the port (n) are connected with each other.

The second pilot valve 75 is a five-port three-position selector valve of a spring center type.

Of the five ports of the second pilot valve 75, a first port (r) is connected with the pressure detection port (p) of the first pilot valve 74. A second port (s) is connected with the pressure detection port (q) of the first pilot valve 74. The third port (t) is connected with the port (d) of the main selector valve 82, the port (f) of the main valve 73, and the port (l) of the first pilot valve 74. The fourth port (u) is connected with the rod side of the hydraulic cylinders 63A and 63B and the port (h) of the main valve 73. The fifth port (v) is connected with the piston side of the hydraulic cylinders 63A and 63B and the port (g) of the main valve 73.

A pressure detection port (w) of the second pilot valve 75 is connected with the rod side of the hydraulic cylinders 63A and 63B and the port (h) of the main valve 73. A pressure detection port (x) of the second pilot valve 75 is connected with the piston side of the hydraulic cylinders 63A and 63B and the port (g) of the main valve 73.

When the difference between the pilot pressure applied to the pressure detection port (w) and that applied to the pressure detection port (x) is smaller than the urging force of springs 75*a* and 75*b*, the second pilot valve 75 is located at a position (G). As a result, the port (r) and the port (s) are connected with the port (t) whereas the port (u) is disconnected from the port (v).

When the difference between the pilot pressure applied to the pressure detection port (w) and that applied to the pressure detection port (x) is greater than the urging force of the first spring 75*a*, the second pilot valve 75 is switched to a position (H). As a result, the port (u) and the port (r) are connected with each other, and the port (s) and the port (t) are connected with each other, and the port (v) is closed. As described previously, the pressure detection port (w) is connected with the rod side of the hydraulic cylinders 63A and 63B. The second pilot valve 75 is switched to the position (H) when the hydraulic pressure at the rod side of the hydraulic cylinders 63A and 63B becomes high, i.e., when the rod 67 has retracted to the maximum. Accordingly, the switch from the retraction operation of the rod 67 to its extension operation, namely, the switch from the opening operation of the movable member 49 to its closing operation can be adjusted by adjusting the urging force of the first spring 75*a*.

When the difference between the pilot pressure applied to the pressure detection port (x) and that applied to the pressure detection port (w) is greater than the urging force of the second spring 75*b*, the second pilot valve 75 is switched to a position (I). As a result, the port (r) and the port (t) are connected with each other, and the port (v) and the port (s) are connected with each other, and the port (u) is closed. As described previously, the pressure detection port (x) is connected with the piston side of the hydraulic cylinders 63A and 63B. The second pilot valve 75 is switched to the position (I) when the hydraulic pressure at the piston side of the hydraulic cylinders 63A and 63B becomes high, i.e., when the rod 67 has extended to the maximum or an object remain sandwiched between the movable member 49 and the fixed member 42. Accordingly, the switch from the extension operation of the rod 67 to its retraction operation, namely, the switching from the closing operation of the movable member 49 to its opening operation can be adjusted by adjusting the urging force of the second spring 75*b*.

Referring to FIG. 6, a pipe line 85*a* connects the port (c) of the main selector valve 82 and the port (e) of the main valve 73 with each other. A pipe line 85*b* connects the port (d) of the main selector valve 82 and the port (f) of the main valve 73 with each other. Pipe lines 85*c* and 85*d* connect the port (g) of the main valve 73 and the piston side of the hydraulic cylinder 63A and that of the hydraulic cylinder 63B with each other, respectively. Pipe lines 85*e* and 85*f* connect the port (h) of the main valve 73 and the rod side of the hydraulic cylinder 63A and that of the hydraulic cylinder 63B with each other, respectively. A pipe line 86*a* of FIG. 2 (A) supplies the shaft-receiving hole 54*a* with lubricating oil. Pipe lines 88*a* through 88*d* shown in FIG. 5 connect the main valve 73 and the first pilot valve 74 with each other and the main valve 73 and the second pilot valve 75 with each other.

Figure 7B:
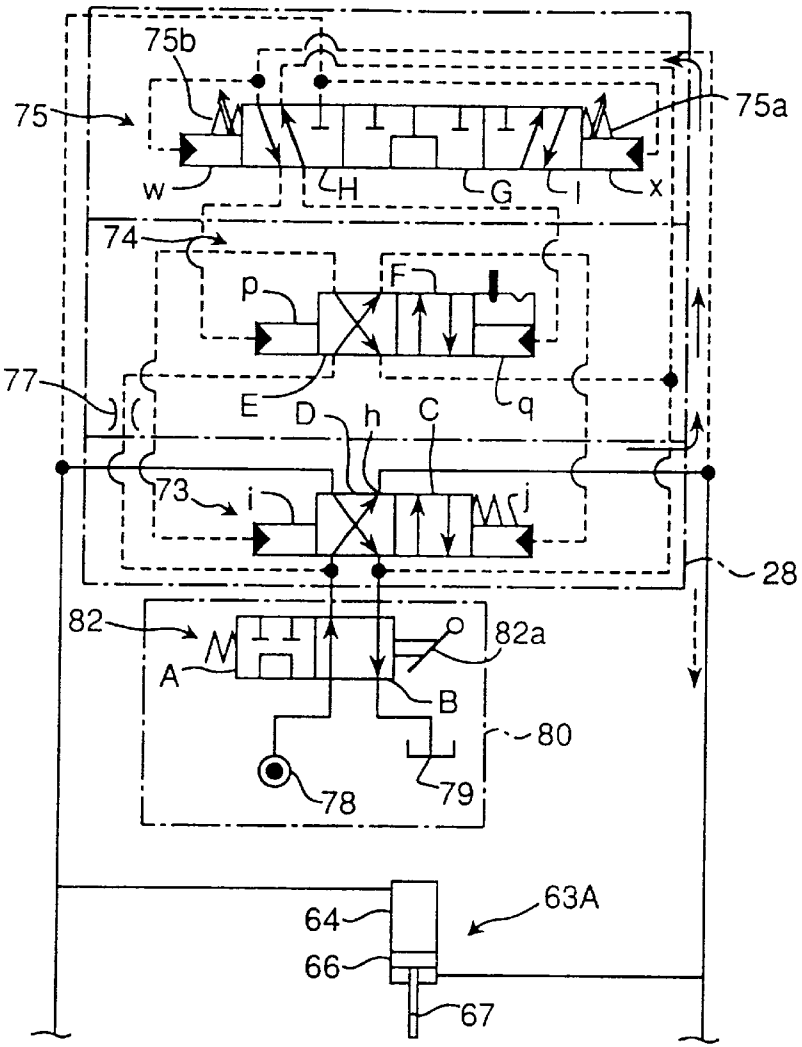
FIGS. 7 (A) and 7 (B) are circuit diagrams showing the operation of the driving device.
Figure 7A:
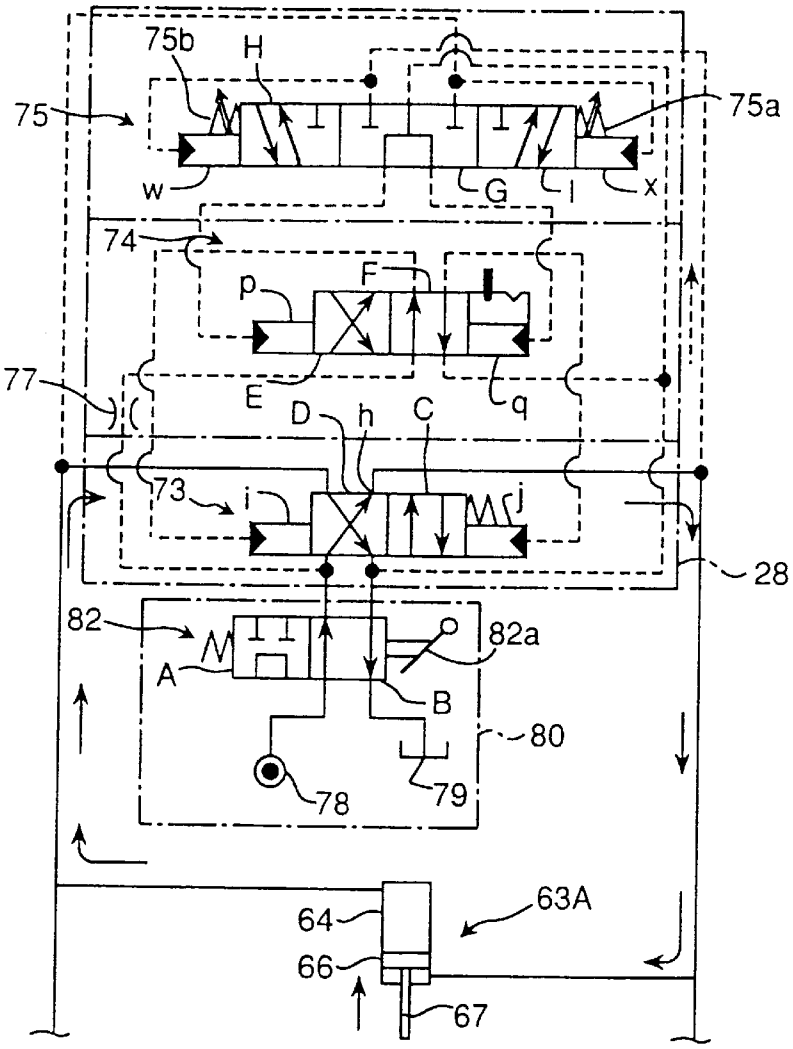

As shown in FIG. 6, upon operation of the lever 82*a* to switch the main selector valve 82 from the position (A) to the position (B) when the main valve 73 is located at the position (C), the first pilot valve 74 is located at the position (E), and the second pilot valve 75 is located at the position (D), the hydraulic pressure at the hydraulic pump side is applied to the pressure detection port (i) of the main valve 73, and the hydraulic pressure at the reservoir side is applied to the pressure detection port (j) thereof as shown in FIG. 7. Therefore, pressure oil is supplied to the rod side of each of the hydraulic cylinders 63A and 63B from the hydraulic pump 78, while the piston side of each of the hydraulic cylinders 63A and 63B is connected with the reservoir 79. Consequently, the rod 67 retracts. The hydraulic pressure at the hydraulic pump side is applied to the pressure detection port (w) of the second pilot valve 75, whereas the hydraulic pressure at the reservoir side is applied to the pressure detection port (x) thereof. The difference between the two pilot pressures is smaller than the urging force of the first spring 75*a*. Thus, the second pilot valve 75 remains at the position (G).

When the rod 67 has reached the upper end (extension end) in the state shown in FIG. 7 (A), the pressure to be applied to the port (h) of the main valve 73 rises, and the pilot pressure to be applied to the pressure detection port (w) of the second pilot valve 75 rises. Consequently, the difference between the pilot pressure applied to the pressure detection port (w) of the second pilot valve 75 and that applied to the pressure detection port (x) is greater than the urging force of the first spring 75*a*. As a result, the position of the second pilot valve 75 is switched from the position (G) to the position (H)

When the position of the second pilot valve 75 is switched to the position (H), as shown in FIG. 7 (B), the pressure detection port (p) of the first pilot valve 74 is connected with the hydraulic pump side and the pressure detection port (q) thereof is connected with the reservoir side. Due to the difference between the pilot pressure applied to the pressure detection port (p) and that applied to the pressure detection port (q), the position of the first pilot valve 74 is switched to the position (E).

Figure 8B:
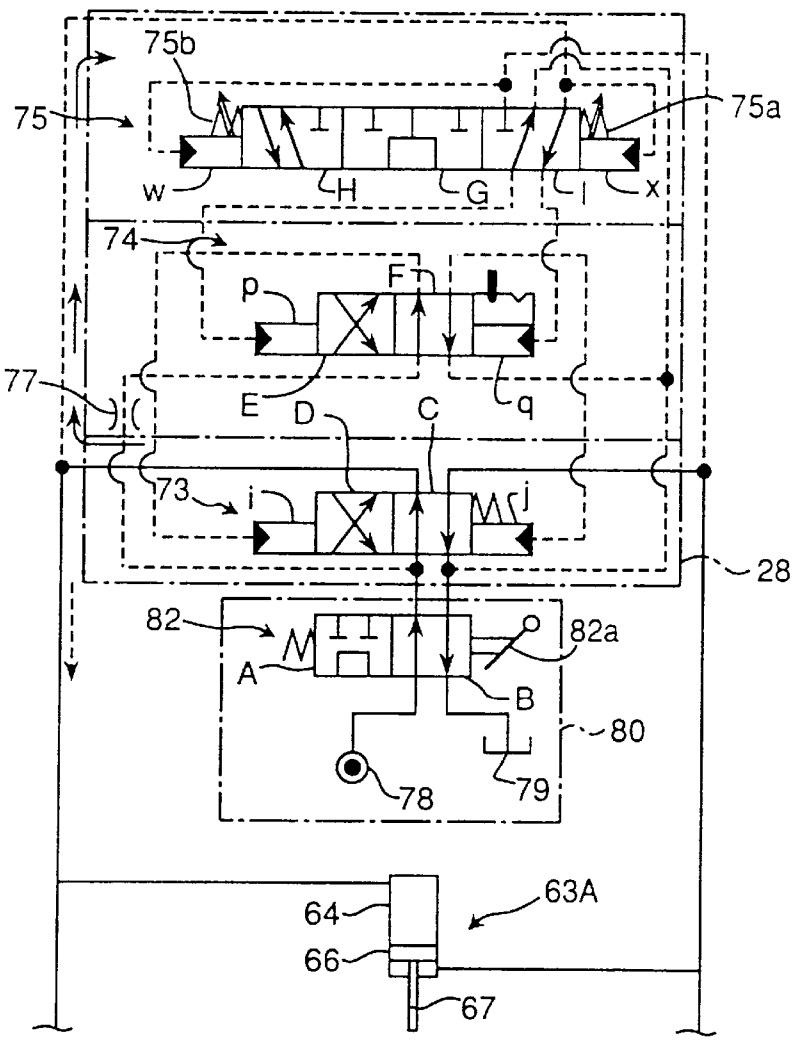
FIGS. 8 (A) and 8 (B) are circuit diagrams showing the operation of the driving device.
Figure 8A:
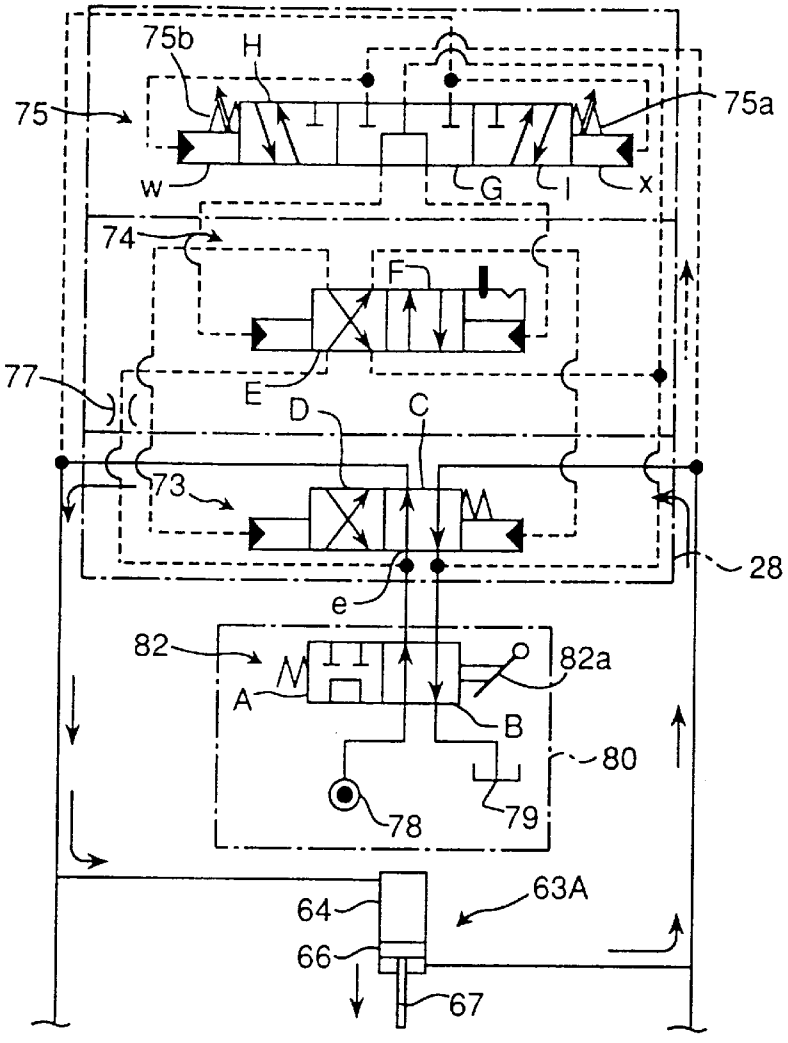
Figure 9:
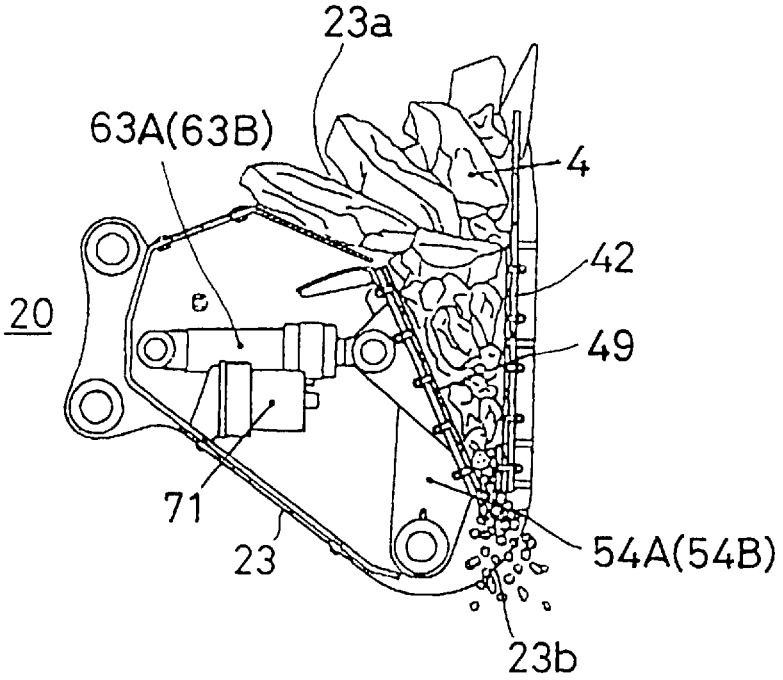
FIG. 9 is a view showing an operation state in which an object is crushed by the crusher of the first embodiment.

As shown in FIG. 7 (B), as a result of the switching of the second pilot valve 75 to the position (H) and that of the first pilot valve 74 to the position (E), the hydraulic pressure at the hydraulic pump side is applied to the pressure detection port (j) of the main valve 73, whereas the hydraulic pressure at the reservoir side is applied to the pressure detection port (i) of the main valve 73. As a result, the main valve 73 is switched to the position (C), and the rod 67 starts to move downward. This state is shown in FIG. 8 (A)

At the start of the downward movement of the rod 67, the pressure detection port (x) of the second pilot valve 75 is connected with the reservoir side, and the pressure detection port (w) is connected with the hydraulic pump side. At this time, the difference between the pilot pressure applied to the pressure detection port (x) and that applied to the pressure detection port (w) is not greater than the urging force of the first spring 75*a*. Thus, the second pilot valve 75 is switched to the position (G) by the urging force of the first spring 75*a*. As a result of the switching of the second pilot valve 75 to the position (G), the hydraulic pressure at the reservoir side is applied to the pressure detection ports (p) and (q) of the first pilot valve 74. But as described previously, the first pilot valve 74 is of detent type, the first pilot valve 74 is kept at the position (E) even though the difference between the pilot pressure applied to the pressure detection port (x) and that applied to the pressure detection port (w) is not greater than the urging force of the first spring 75*a*.

When the rods 67 of the hydraulic cylinders 63A and 63B has moved downward to the lowest end (retracted to the maximum), the pressure of port (e) of the main valve 73 rises and the difference between the pilot pressure applied to the pressure detection port (x) of the second pilot valve 75 and that applied to the pressure detection port (w) is greater than the urging force of the first spring 75*a*. As a result, as shown in FIG. 8 (B), the second pilot valve 75 is switched from the position (G) to the position (I). Consequently, the pressure detection port (q) of the first pilot valve 74 is connected with the hydraulic pump side, whereas the pressure detection port (p) of the first pilot valve 74 is connected with the reservoir side. Due to the difference in the pilot pressures, the first pilot valve 74 is switched to the position (F). As a result of the switching of the second pilot valve 75 to the position (I) and that of the first pilot valve 74 to the position (F), the pressure detection port (i) of the main valve 73 is connected with the hydraulic pump side, and the pressure detection port (i) of the main valve 73 is connected with the reservoir side. Due to the pressure difference in the pilot pressures, the main valve 73 is switched to the position (D). As a result, the rod 67 of the hydraulic cylinders 63A and 63B starts to move upward (extend.)

As a result of the switching of the main valve 73 to the position (D), the pressure detection port (w) of the second pilot valve 75 is connected with the hydraulic pump side, and the pressure detection port (x) thereof is connected with the reservoir side. At this time, because the difference in the pilot pressures is smaller than the urging force of the first spring 75*a*, the second pilot valve 75 is switched to the position (G), as shown in FIG. 7 (A). Similarly to the above-described manner, the rod 67 of each of the hydraulic cylinders 63A and 63B extends and retracts repeatedly, thus causing the movable member 49 to perform the opening and closing operations repeatedly by keeping the operation lever 82*a* at the operation position. The operation of the rod 67 can be stopped by operating the operation lever 82*a* to switch the main selector valve 82 to the position (B) from the position (A).

Unlike the case shown in FIG. 7 (A), when the first pilot valve 74 is located at the position (C) when a previous operation is stopped, the above-described operation is started from the state shown in FIG. 8 (A) when the rod 67 is halfway between the upper and lower ends of its reciprocating movement, whereas the above-described operation starts from the state shown in FIG. 8 (B) when the rod 67 is located at the lower end of its stroke.

When an object supplied between the fixed member 42 and the movable member 49 cannot be crushed and the movable member 49 stops, with the object sandwiched therebetween while it is performing the closing operation (extension operation of the rod 67), the pressure at the piston side of the hydraulic cylinders 63A and 63B rises in the state shown in FIG. 8 (A). Due to the pressure rise, the difference between the pilot pressure applied to the pressure detection port (x) of the second pilot valve 75 and that applied to the pressure detection port (w) thereof becomes greater than the urging force of the second spring 75*b*, with the result that the second pilot valve 75 is switched to the position (I). As a result of the switching of the second pilot valve 75, the first pilot valve 74 is switched to the position (F), and the main valve 73 is switched to the position (C). Thus, as shown in FIG. 7 (A), the piston side of each of the hydraulic cylinders 63A and 63B is switched to reservoir side and the rod 67 is connected with the pump side 78. As a result, the rod 67 starts to retract and the second pilot valve 75 is returned to the position (G) by the urging force of the first and second springs 75*a* and 75*b*. Similarly to the above-described manner, each rod 67 of the hydraulic cylinders 63A and 63B extends and retracts repeatedly.

In the jaw-type crusher of the present invention, the pressure at the piston side of the hydraulic cylinders 63A and 63B and that at the rod side thereof are detected to perform opening and closing operations automatically. When an operator operates the operation lever 82*a*, the rod 67 extends and retracts repeatedly automatically to open and close the movable member 49 repeatedly. Thus, it is not necessary for the operator to operate the operation lever 82*a* repeatedly. That is, the jaw-type crusher has a high operability and crushing performance.

When an object sandwiched between the movable member 49 and the fixed member 42 cannot be crushed in one closing operation of the movable member 49, i.e., when it remains sandwiched between the movable member 49 and the fixed member 42 during the closing operation of the movable member 49, the rise in the pressure at the piston side of the hydraulic cylinders 63A and 63B is detected to cause the movable member 49 to perform the opening operation. Therefore, an excessive force can be prevented from being applied to the movable member 49 and the fixed member 42.

As shown in FIG. 1, the jaw-type crusher of the first embodiment is installed on the power shovel 15. After an object is introduced into the frame 23 from an upper opening 23*a* of the frame 23 shown in FIGS. 2 (A) and 9 by driving the boom and the arm of the power shovel, an operator sets the operation lever 82*a* to the operation position. As a result, as shown by the arrow of FIG. 4, the movable member 49 rotates with the supporting shaft 37 at its rotational center, thus crushing the object sandwiched between the movable member 49 and the fixed member 42. Crushed pieces are discharged from the discharge port 23*b* located at the lower end of the frame 23. At this time, when the movable member 49 stops while the object is being crushed because the object is not crushed by one-time closing operation of the movable member 49, the control mechanism 71 detects the pressure rise of the hydraulic cylinders 63A and 63B automatically, thus proceeding to the opening operation. Therefore, an excessive force can be prevented from being applied to the movable member 49.

The supporting point (O) of the supporting shaft 37 is located below the rod 67 of each of the hydraulic cylinders 63A and 63B when the rod 67 is extended to the maximum. When the rod 67 moves forward and backward repeatedly, the movable member 49 approaches the fixed member 42 and recreates therefrom repeatedly while the movable member 49 is moving, thus crushing an object 4 between the crushing plate 52 of the movable member 49 and the crushing plate 44 of the fixed member 42. In the crushing operation, an operation having the following characteristics is performed:

That is, as shown in FIG. 4, when the rod 67 is retracted to the maximum, the supporting shaft 58 fixed to the rod 67 and the movable member 49 is located at the rear of the supporting point (O) of the supporting shaft 37. Thus, the upper part of the movable member 49 inclines rearward, thus forming a crushing space (C) between the movable member 49 and the fixed member 42. The supporting point (O) is located below the movable member 49 and forward from the rod 67; and the cylinder 64 of the hydraulic cylinders 63A and 63B is rotatably supported by the frame through the supporting shaft 61; and the movable member 49 and the rod 67 are rotatably fixed to the rod 67. Therefore, when the rod 67 is pressed forward toward the fixed member 42, the movable member 49 approaches the fixed member 42 while it is moving and the cylinder 64 and the rod 67 are inclining, as shown by one-dot chain line of FIG. 4. In this manner, the object 4 is compressed and crushed by the crushing plate 52 of the movable member 49 and the crushing plate 44 of the fixed member 42 in the narrowed space (C). At this time, the movable member 49 moves downward while it is moving, thus pressing the object 4 downward to the discharge port 23b. As shown by one-dot chain line of FIG. 4, when the rod 67 is extended to the maximum, the space (C) between the movable member 49 and the fixed member 42 becomes smallest and the rod 67 starts to retract Because the supporting point (O) is located below the movable member 49 and the center of the movable member 49 is rotatably mounted on the rod 67, the movable member 49 approaches the fixed member 42 and recreates therefrom repeatedly while the movable member 49 is moving. In the operation of the movable member 49, the object 4 introduced into the crushing space (C) is stricken by means of the crushing plate 52 of the movable member 49 and the crushing plate 44 of the fixed member 42 and crushed into small pieces and discharged from the discharge port 23*b*.

Figure 10A:
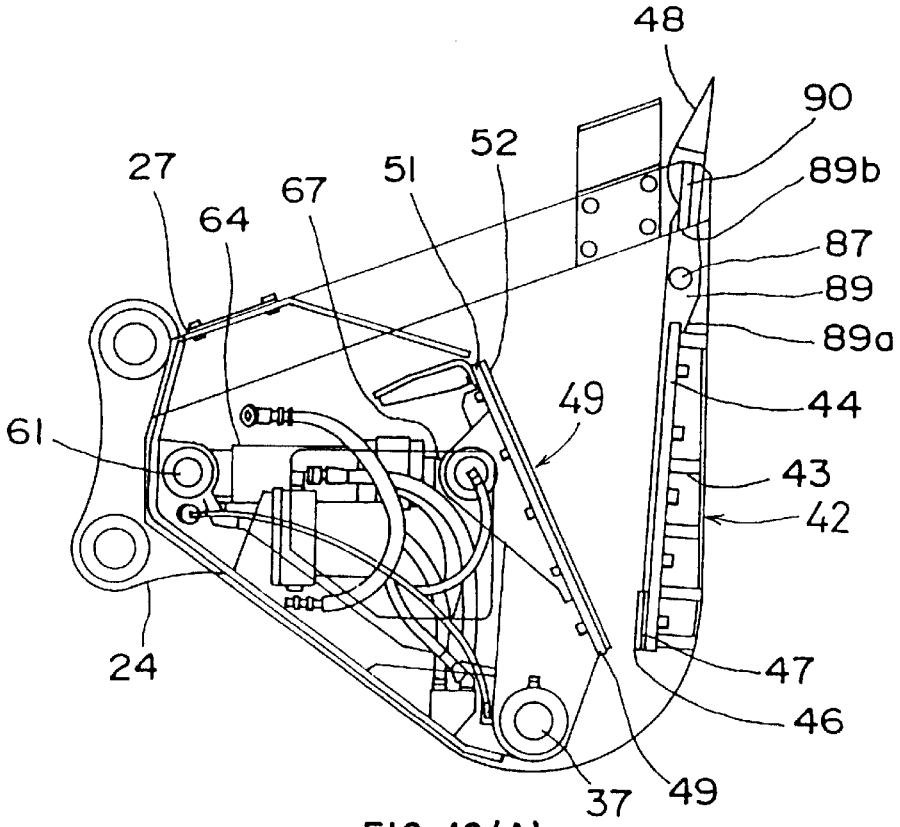
FIG. 10 (A) is a side view showing a state in which one of side plates of a jaw-type crusher according to a second embodiment of the present invention has been removed.
Figure 10B:
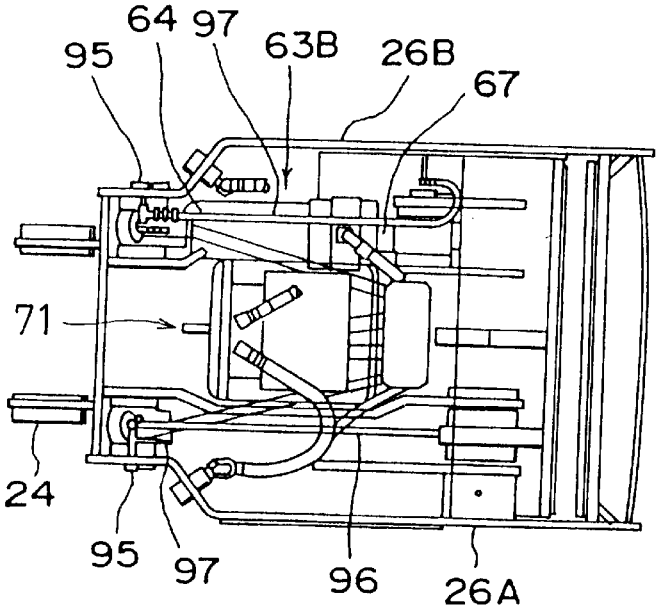

FIGS. 10 (A), 10 (B), and 11 show the second embodiment of the present invention. The upper end of the fixed member 42 of the second embodiment is different from that of the first embodiment.

That is, the base plate 43 of the fixed member 42 and the crushing plate 44 thereof are positioned below the upper end of the frame 23, and a shaft member 87 is installed between the side plates 26A and 26B by providing a space between the upper end of the fixed member 42 and the shaft member 87. A plurality of frame plate members 89 is formed on the shaft member 87 such that the frame plate members 89 are spaced at predetermined intervals in the right-to-left direction of the side plates 26A and 26B. A notch 89a is formed at the lower end of each frame plate member 89 so that the base plate 43 of the fixed member 42 is fitted in the notch 89*a*. A notch 89*b* is formed on the upper end of each frame plate member 89 so that a shoveling plate 90 on which a plurality of the claws 48 are formed at predetermined intervals in the right-to-left direction of the jaw-type crusher 20 is fitted in the notch 89*b*.

Figure 11:
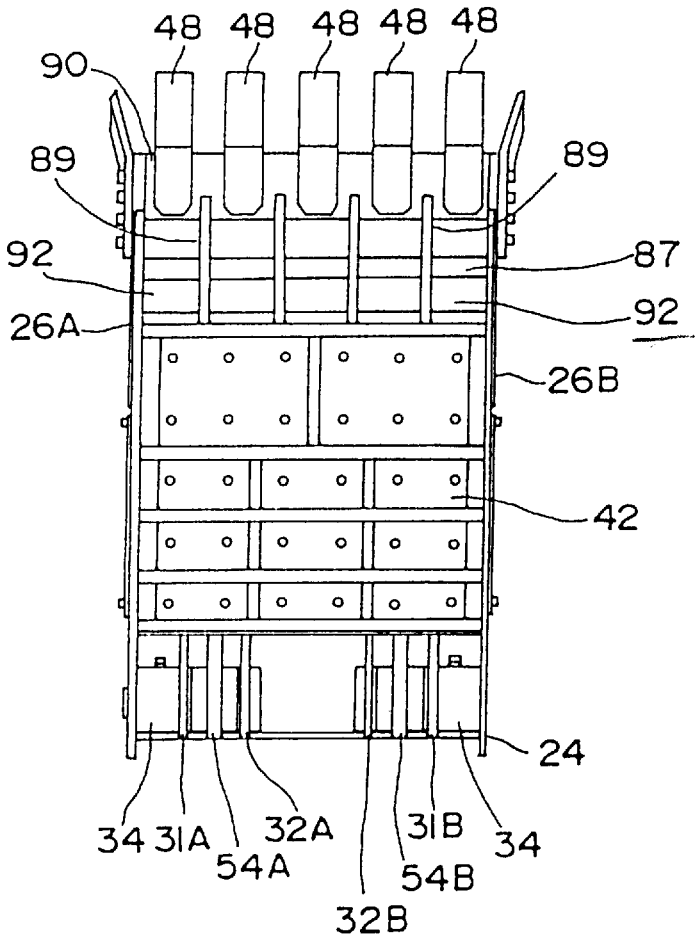
FIG. 11 is a front view showing the crusher according to the second embodiment of the present invention.

Referring to FIG. 11, the shaft members 87 and the frame plate members 89 constitute a plurality of rectangular openings 92 between the upper end of the fixed member 42 and the lower end of the shoveling plate 90. The lattice-shaped part composed of the openings 92 formed at the front end of the frame 23 drop earth and sand mixed with stones and rocks to the outside when they are shoveled into the frame 23. That is, in performing a crushing operation by driving the movable member 49, the openings 92 prevent earth and sand from being supplied to the space between the movable member 49 and the fixed member 42, thus preventing the discharge opening 23*b* from being clogged with earth and sand.

The jaw-type crusher of the second embodiment is not provided with the pipe line connecting the main valve 73 and the first pilot valve 74 with each other and the one connecting the main valve 73 and the second pilot valve 75 with each other. Hydraulic paths provided in a casing constituting the valves form flow passages.

Referring to FIG. 10 (B), the control mechanism 71 has a lubricating oil supply opening 95 formed in the vicinity of the supporting shaft 61. The end of a pipe line 96 and that of a pipe line 97 extending from the lubricating oil supply opening 95 are connected with the shaft-receiving hole 54*a* of the supporting arm 54A and the shaft-receiving hole 67*a* of the rod 67, respectively. This construction allows lubricating oil to be supplied to the shaft-receiving holes 54*a* and 67*a* simultaneously from the lubricating oil supply opening 95, thus allowing a lubricating oil-supply work to be accomplished efficiently.

The other constructions of the second embodiment are similar to those of the first embodiment. Thus, like parts are designated by like reference numerals and the descriptions thereof are omitted herein.

Figure 12:
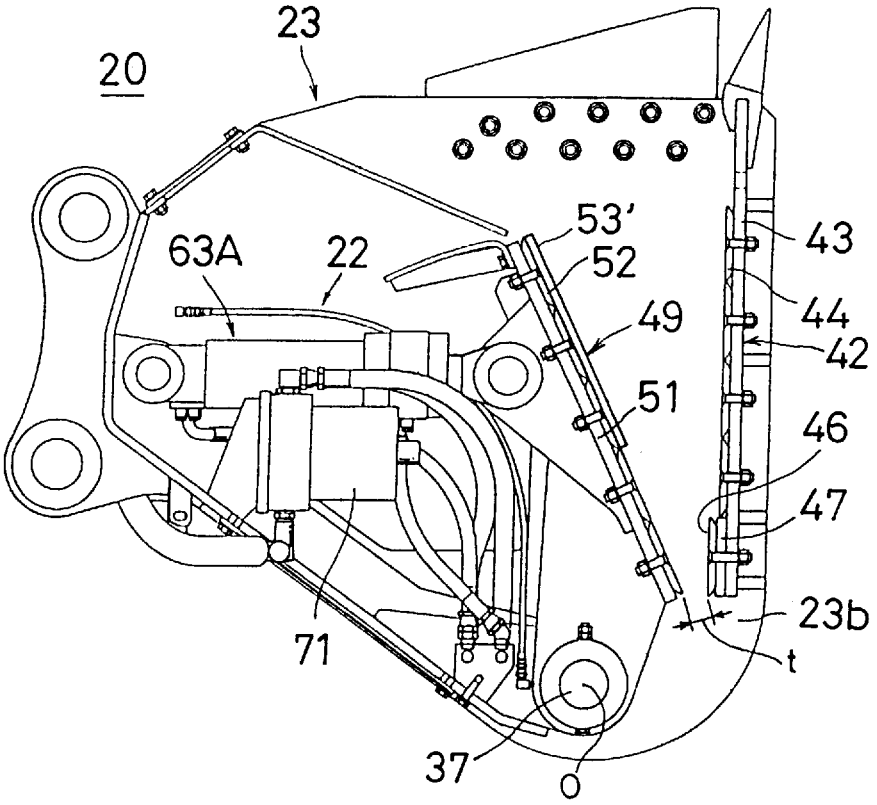
FIG. 12 is a side view showing a state in which one of side plates of a jaw-type crusher according to a third embodiment of the present invention has been removed.
Figure 13:
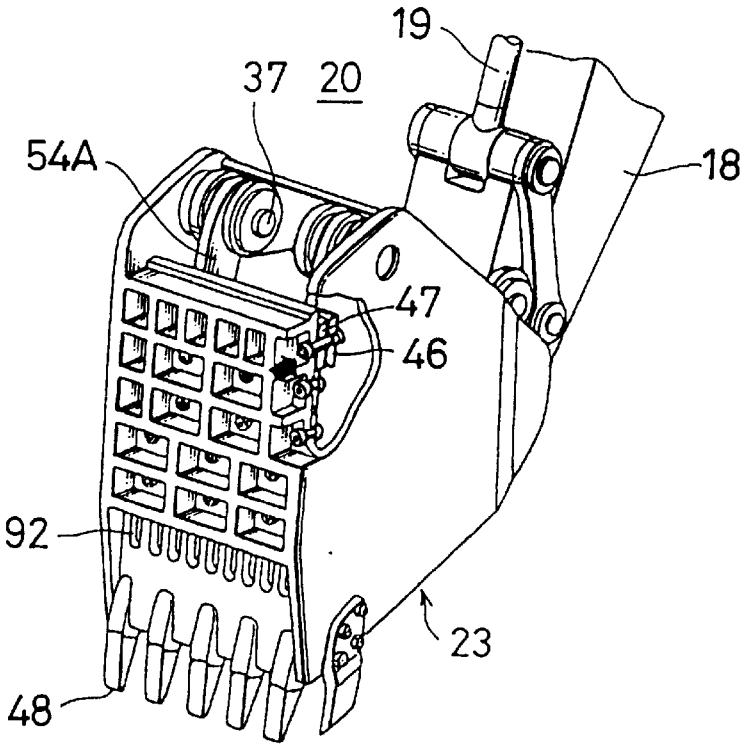
FIG. 13 is a perspective view showing a fixed plate of the crusher according to the third embodiment of the present invention has been removed.
Figure 14:
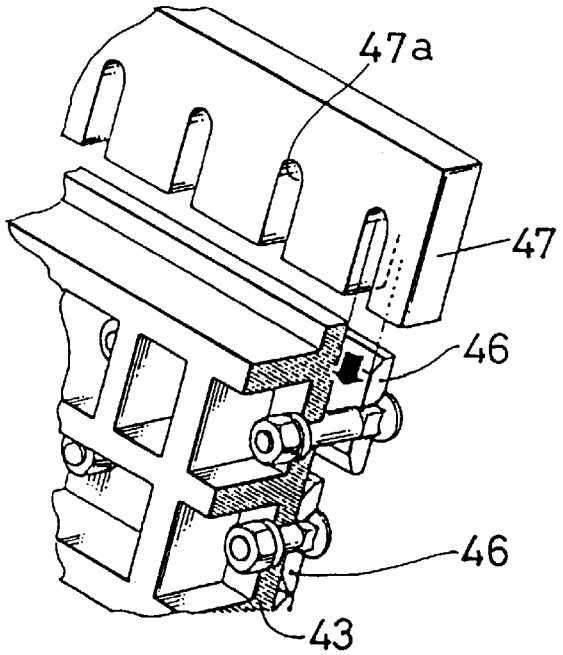
FIG. 14 is an exploded perspective view showing an adjusting plate-mounted portion of the crusher according to the third embodiment of the present invention has been removed.

FIGS. 12 through 14 show the third embodiment of the present invention. Five crushing plates 52 are fixed lengthwise side by side to the front surface of the substrate 51 of the movable member 49 by means of bolts. The crushing plates 52 may be replaced when they have been worn due to crushing. A plurality of (three in third embodiment) straight crushing projections 53' is installed widthwise at regular intervals on an upper part of the front surface of the substrate 51 to crush an object efficiently between the movable member 49 and the fixed member 42. The crushing projections 53' of this shape allows a crushed object to be flowed to the discharge port 23*b* more smoothly than the one of the first embodiment shown in FIGS. 2 (A) and 2 (B).

Five crushing plates 44 are lengthwise side by side fixed to the base plate 43 with bolts. The lowermost crushing plate 44 is fixed to the base plate 43 with bolts by interposing the adjusting plate 47 between the lowermost crushing plate 44 and the base plate 43 so as to adjust the interval (t) between the fixed member 42 and the movable member 49.

As shown in FIG. 14, the flat adjusting plate 47 has comb-shaped through-grooves 47*a* formed thereon at regular intervals. The adjusting plate 47 is fixed to the base plate 43 with bolts such that it is interposed between the substrate 43 and the crushing plate 44. Three kinds of the adjusting plate 47 having different thicknesses are provided. That is, the adjusting plate T1 has a thickness of 12 mm (T1); the adjusting plate T2 has a thickness of 9 mm; the adjusting plate T3 has a thickness of and 6 mm. The relationship between the total thickness of the adjusting plate 47 and the dimension of an object crushed and discharged from the discharge port 23*b* is set as shown in table 1 below. As shown in table 1, when the adjusting plate 47 is not installed on the fixed member 42, the object is crushed into a dimension of 70 mm; when the three adjusting plates 47 are installed on the fixed member 42, the object is crushed into a dimension 43 mm. In this manner, the object is crushed into a dimension in the range of 70 mm–43 mm.

TABLE 1

| plate | nil | T3 | T2 | T1 | T3 + T2 | T3 + T1 | T1 + T2 | T1 + T2 + T3 |
|---|---|---|---|---|---|---|---|---|
| Size (mm) | 70 | 64 | 61 | 58 | 55 | 52 | 49 | 43 |

Figure 15:
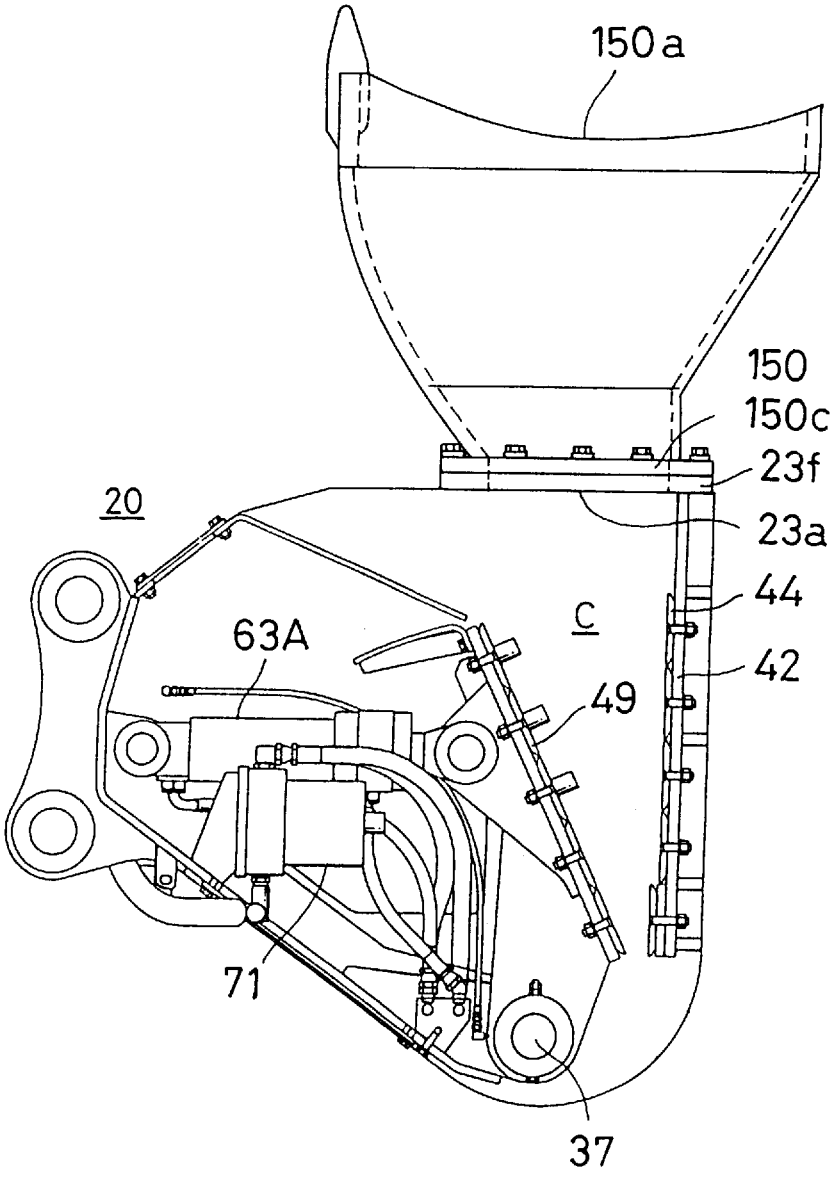
FIG. 15 is a side view showing a state in which one of side plates of a jaw-type crusher according to a fourth embodiment of the present invention has been removed.

FIG. 15 shows the jaw-type crusher according to the fourth embodiment of the present invention. A hopper 150 is installed on the upper end of the frame 23. The hopper 150 is in the shape of a quadrangular pyramid. That is, the sectional area of the hopper 150 becomes gradually smaller from an upper opening 150*a* thereof toward a lower opening thereof. A flange 150*c* formed in the periphery of the lower opening of the hopper 150 is fixed to a flange 23*f* projecting from a side plate of the frame 23 with bolts, with the lower opening communicating with an opening 23*a* of the frame 23 formed at its upper end.

The hopper 150 shovels an object, thus storing them inside the hopper 150. Then, the arm and the link of the power shovel are driven to rotate the hopper 150 to the upper position as shown in FIG. 15. In this state, the object is put into the crushing space (C) between the fixed member 42 and the movable member 49 from the lower opening of the hopper 150. Then, the hydraulic cylinders 63A and 63B are driven to actuate the 49 similarly to the first embodiment. The object crushed into small pieces is discharged from the discharge port 23*b*.

Because the hopper 150 is provided on the crusher 20, a large amount of objects can be crushed.

Figure 16:
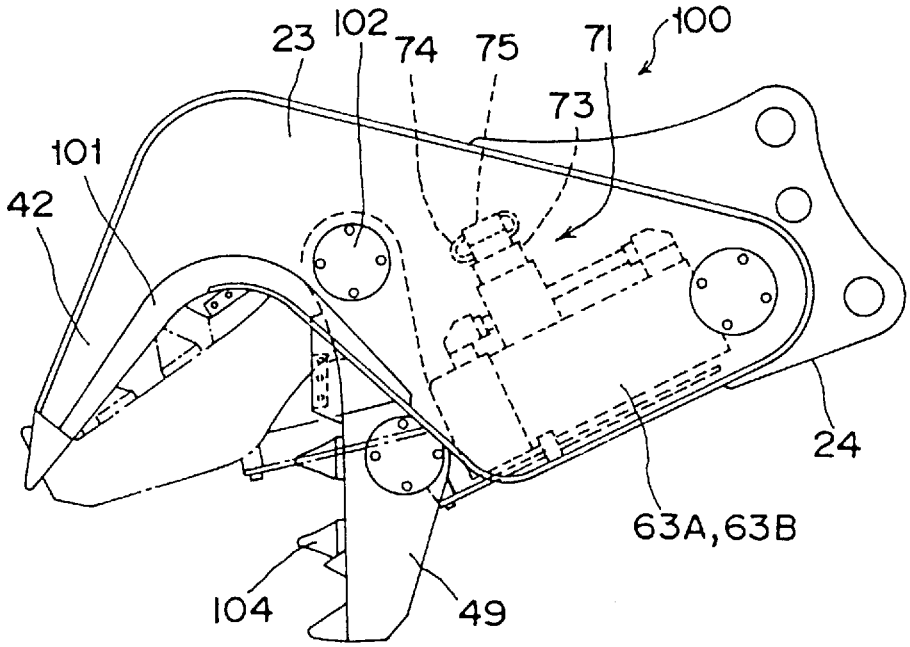
FIG. 16 is a side view showing a modification of the present invention.

As shown in FIG. 16, the jaw-type crusher 20 of the present invention may be installed on a device for dividing into small piece (what is called kowariki) 105 of attachment type. The fixed member 42 of the device 105 is integral with the frame 23 and has a blade 101. The movable member 49 is rotatably supported on one end 102 thereof and has a conic projection 104 formed on the other side thereof. The control mechanism 71 provided on the kowariki 100 allows the movable member 49 to perform an opening and closing operation automatically. Further, when an object is sandwiched between the fixed member 42 and the movable member 49, the control mechanism 71 allows the movable member 49 to perform an opening operation automatically.

In the above-described embodiments, an opening and closing operation is controlled by the operation lever 82*a*, but a push button switch or a pedal may be used instead of the operation lever 82*a*.

The main selector valve 82 is not limited to the one having the construction shown in FIG. 6. In an example shown in FIG. 17 (A), a main selector valve 82' is of four-port three-position type. A port (b) is connected with the reservoir 79 and a port (f) of the main valve 73, whereas a port (d) is closed. In a position (J), the port (a) and the port (b) are connected with each other, and a port (c) is connected with the port (e) of the main valve 73. At a left position (K), the port (a) and the port (d) are connected with each other, and the port (b) and the port (d) are connected with each other. At a right position (L), the port (a) and the port (c) are connected with each other, and the port (b) and the port (d) are connected with each other.

Figure 17A:
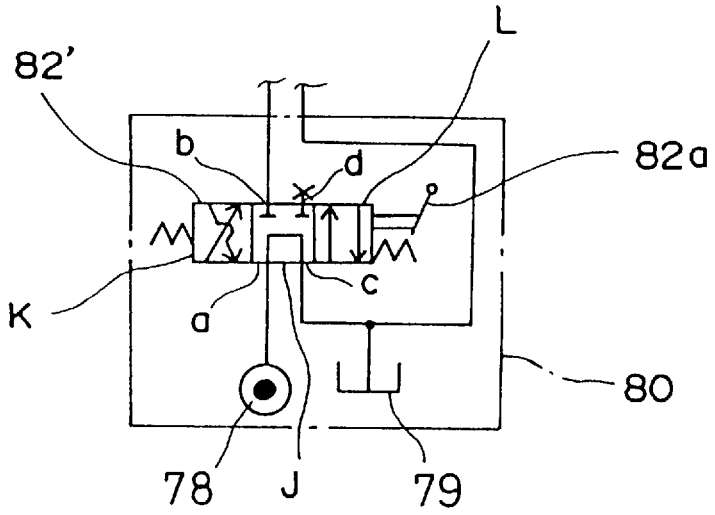
FIGS. 17 (A) and 17 (B) are hydraulic circuit diagrams showing another example of a selector valve.
Figure 17B:
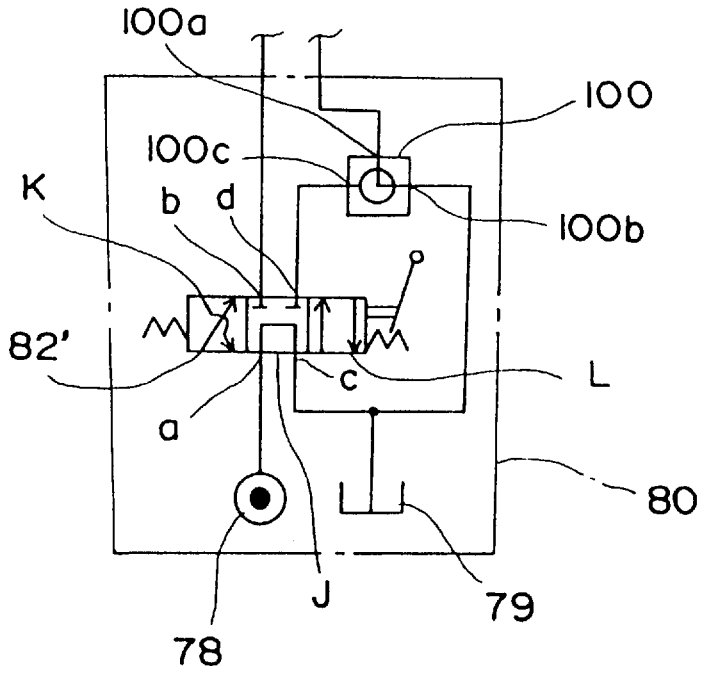

As shown in FIG. 17 (B), a three-way valve 100 is provided inside the body 80 of the power shovel 15. A port 100*a* of the three-way valve 100 is connected with a port (f) of the main valve 73. It is possible to connect ports 100*b* and 100*c* to be selectively connected with the port 100*a* with the port (c) and the port (d) of the main selector valve 82, respectively.

As shown in FIG. 17 (B), when the three-way valve 100 is set to the position at which the port 100*a* and the port 100*b* are connected with each other, the main selector valve 82' is set to a position (K). As a result, the hydraulic cylinders 63A and 63B are actuated. On the other hand, when the three-way valve 100 is set to the position at which the port 100*a* and the port 100*c* are connected with each other, the main selector valve 82 is set to a position (L). As a result, the hydraulic cylinders 63A and 63B are actuated. Accordingly, in the construction shown in FIG. 17 (B), the operation direction of the operation lever 82*a* can be altered by switching the three-way valve 100 in operating the hydraulic cylinders 63A and 63B.

Figure 18A:
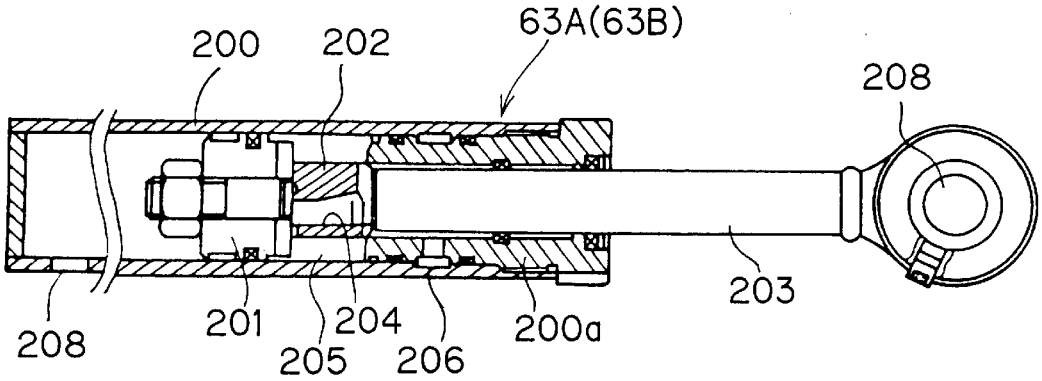
FIG. 18 (A) is a sectional view showing a hydraulic cylinder of a jaw-type crusher according to a fifth embodiment of the present invention.
Figure 18B:
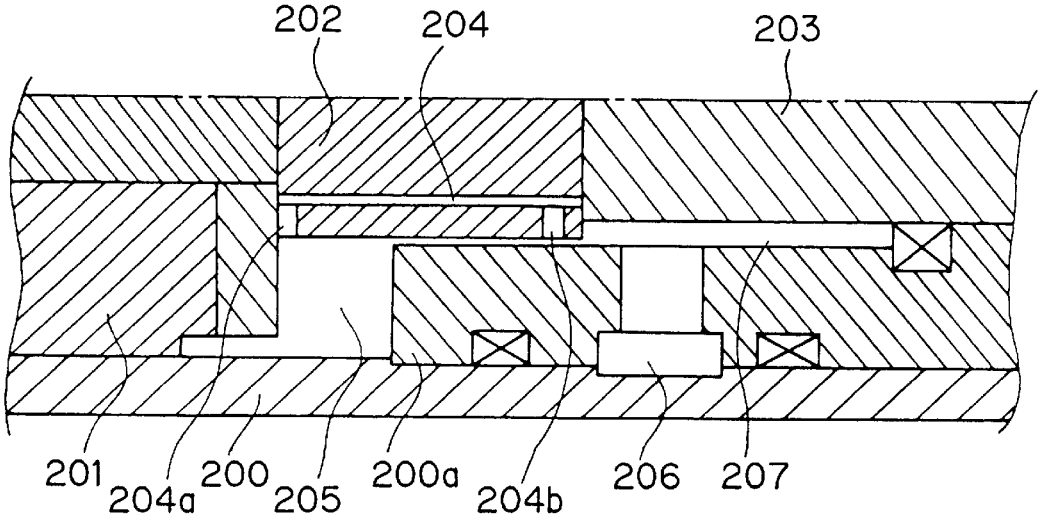

FIG. 18 shows a jaw-type crusher according to the fifth embodiment. In this embodiment, the piston of the hydraulic cylinders 63A and 63B moves at a low speed when it approaches its stroke end of the extension process to weaken the force of the piston when it collides with a cylinder head 200*a*. In this manner, the degree of generated vibrations and noises is reduced.

That is, a pair of hydraulic cylinders 63A. 64B in a horizontal direction to move a movable plate forward and backward repeatedly. The rear end of a cylinder housing 200 of each hydraulic cylinder 63A, 63B is rotatably mounted on a frame. As shown in FIGS. 18 (A) and 18 (B), the piston 201 accommodated slidably in the cylinder housing 200 is connected with a rod 203 through a plunger 202. The front end of the rod 203 is rotatably connected with a bracket projecting from the rear surface of the movable plate through a supporting shaft 208.

The plunger 202 is provided with a small-diameter throttle passage 204 having openings 204*a* and 204*b* formed at both sides thereof in the axial direction thereof. When the piston 201 approaches the stroke end of the extension process, pressure oil flows through the throttle passage 204, and the operation speed of the piston 201 is reduced to weaken the force of the piston 201 when it collides with the cylinder head 200*a*.

That is, as shown in FIG. 18 (B), in the extension process of the piston 201, the pressure oil flows from a hydraulic chamber 205 positioned at the rod side to a lubricating oil entrance/exit 206 positioned at the cylinder head side through a passage 207 located between the rod 203 and a slidable hole of the cylinder head 200*a*. When the piston 201 approaches the stroke end of the extension process, the plunger 202 reaches the slidable hole of the cylinder head 200*a*.

As a result, the lubricating oil flows from the hydraulic chamber 205 to the lubricating oil entrance/exit 206 through the throttle passage 204. Thus, the flow rate is reduced. Consequently, the hydraulic pressure at the front side (cylinder head side) of the piston 201 rises and hence the extension speed of the piston 201 becomes slow. Therefore, the front end of the piston 201 collides with the cylinder head 200*a* with a weak force. With the increase of the hydraulic pressure at the front side of the piston 201, the hydraulic pressure at the bottom side thereof also rises. As a result, the pressure oil is supplied to the lubricating oil entrance/exit 206 and discharged from a lubricating oil entrance/exit 208 at the bottom side of the cylinder housing 200. Consequently, the operation of the piston 201 and that of the rod 203 are switched from the extension operation to the retraction operation.

This construction allows the operation speed of the piston 201 to be slow by the lubricating oil flowing through the throttle passage 204 when the rod 203 approaches the stroke end of its extension process. Therefore, the piston 201 collides with the cylinder head 200*a* at a reduced force, which reduces the degree of generated vibrations and noises.

Figure 19:
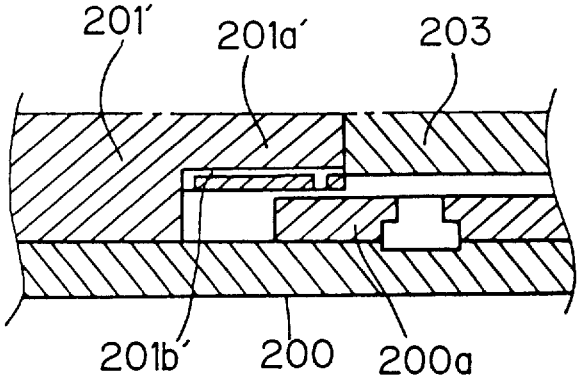
FIG. 19 is a modified sectional view of the FIG. 18 (B)

In the fifth embodiment, the plunger 202 is provided between the head surface of the piston 201 and the rod 203, and the plunger 202 is provided with the throttle passage 204. But instead, as shown in FIG. 19, it is possible to directly connect a piston 201' with the rod 203 without providing the plunger therebetween and form a small-diameter portion 201*a*' at the front end of the piston 201' and provide the small-diameter portion 201*a*' with a throttle passage 201*b*'.

Figure 20:
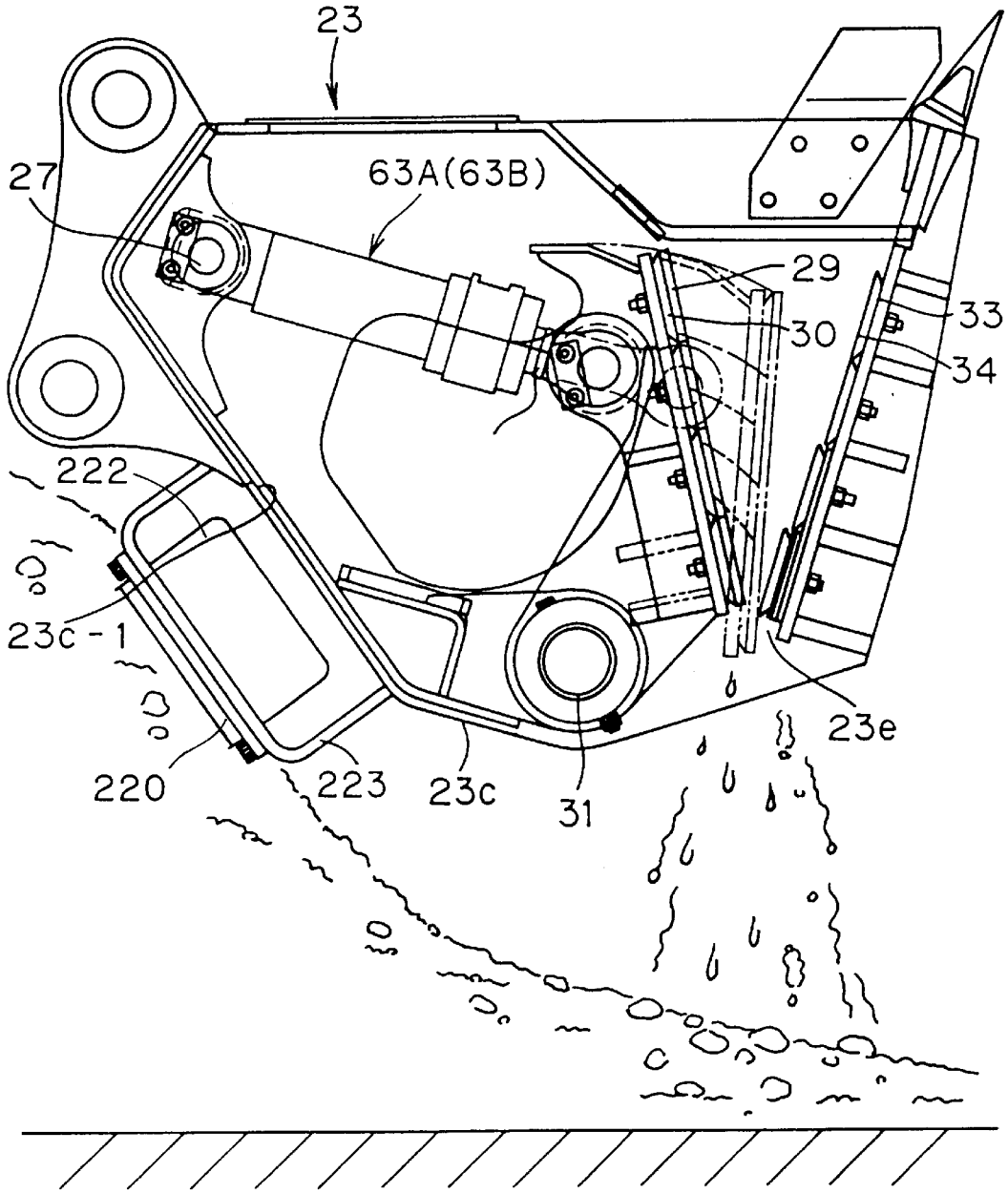
FIG. 20 is a side view showing a state in which one of side plates of a jaw-type crusher according to the sixth embodiment of the present invention.
Figure 21:
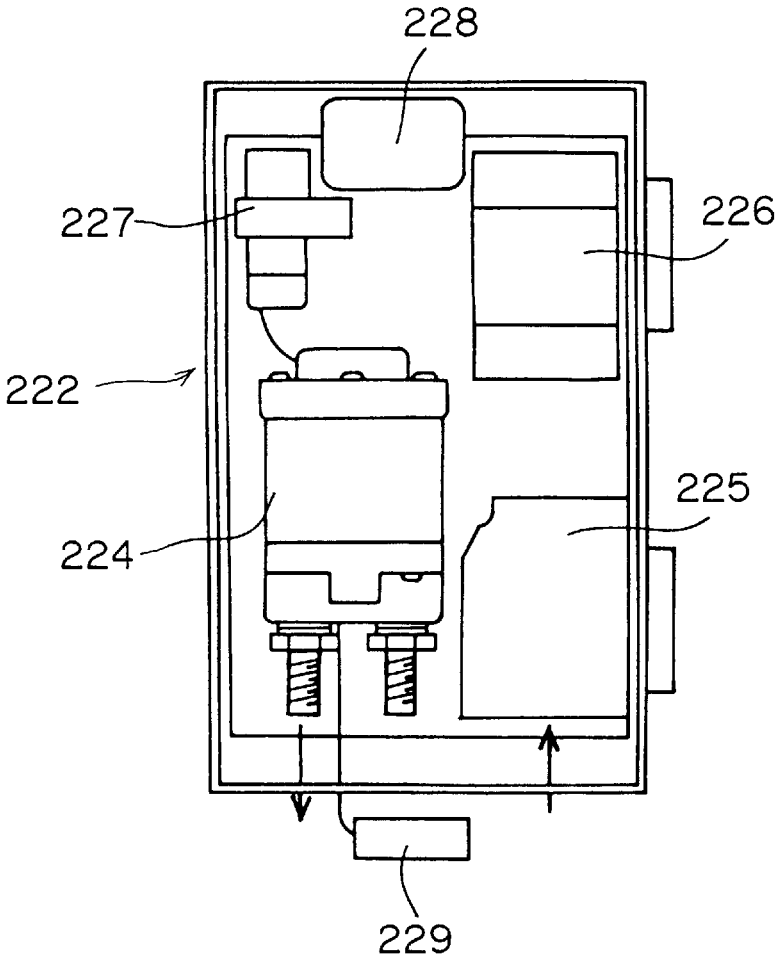
FIG. 21 is a plan view showing an electromagnetic driving device of the sixth embodiment.
Figure 22:
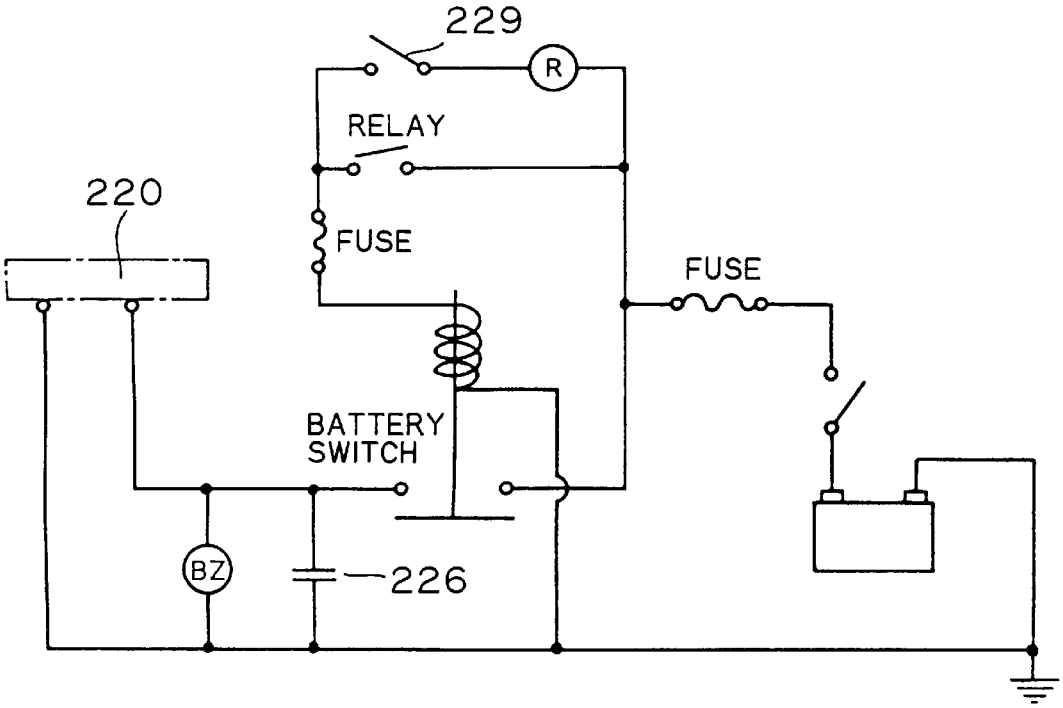
FIG. 22 is a circuit diagram of the electromagnetic driving deceive.
Figure 23A:
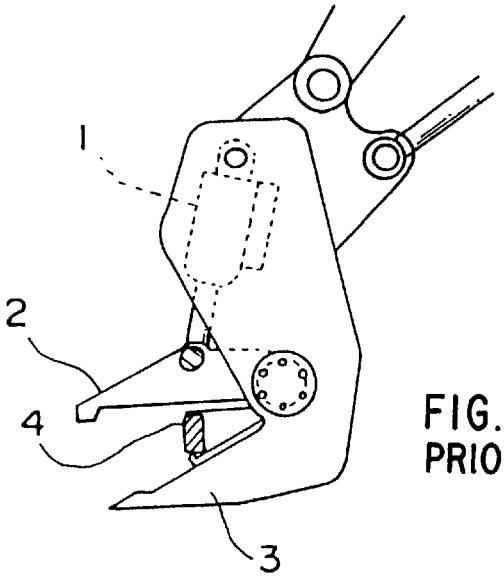
FIG. 23(A) PRIOR ART
FIG. 23 (A) is a side view showing a conventional crusher of attachment type.
Figure 23B:
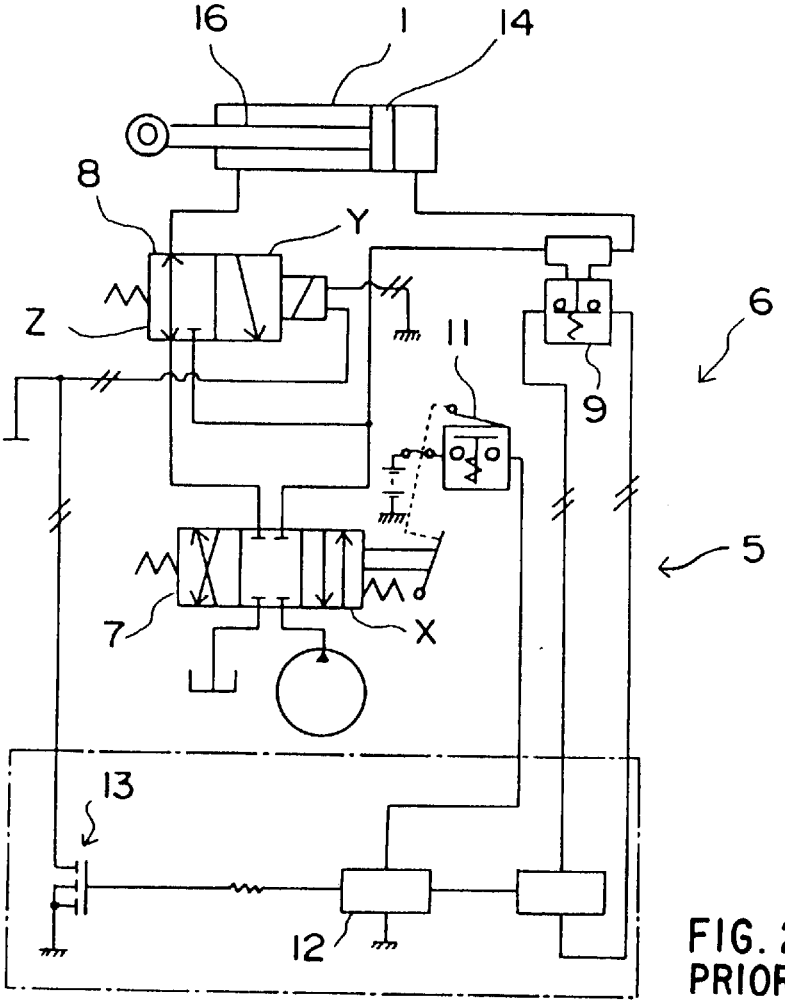
FIG. 23(B) PRIOR ART

FIGS. 20 through 22 show the sixth embodiment of the present invention. The sixth embodiment is different from the first embodiment in that an electromagnet 220 is installed on the outer surface of a lower side 23*c*-1 of a cover 23*c* of a frame 23. That is, a box 223 accommodating an electromagnetic driving device 222 is mounted on the outer surface of the cover 23, and the electromagnet 220 is installed on the outer surface of the box 223 so that the electromagnet 220 is turned and off by the electromagnetic driving device 222.

As shown in FIG. 21, the electromagnetic driving device 222 comprises a battery 224, a fuse box 225, a capacitor 226, a relay 227, and a buzzer 228, thus having a circuit construction shown in FIG. 22. The electromagnetic driving device 222 is connected with an operation switch 229 provided proximately to a driver's seat of the power shovel body through electric wires.

Referring to FIG. 20, when an object inside the frame 23 are discharged from the lower end of the frame 23 while it is being crushed, the lower end of the frame 23 contacts the crushed object. At this time, the operation switch 229 is turned on to energize the electromagnet 220. Small metallic objects such as nails, bolts, nuts and the like mixed with the crushed object are attracted to the electromagnet 220.

When the electromagnet 220 is unenergized at a predetermined position, metallic objects attracted to the electromagnet 220 drop and are collected. In this manner, they can be collected separately from unmetallic objects.

As apparent from the foregoing description, in the crusher of the present invention, when the movable member has started to operate, it approaches the fixed member and retreats therefrom automatically. Thus, it is not necessary for an operator to operate the lever and the like, each time the movable member approaches the fixed member and retreats therefrom. That is, the jaw crusher has a high operability and crushing performance.

When an object is sandwiched between the movable member and the fixed member, the hydraulic pressure of the hydraulic cylinder rises above the predetermined value. As a result, the rod of the hydraulic cylinder is switched from the extension operation to the retraction operation. Therefore, an excessive degree of force can be prevented from being applied to the movable member.

Further, in the jaw-type crusher of the present invention, because the frame thereof accommodates the fixed member, the movable member, and the driving device, the crusher has a simple construction and is compact and light. Thus, the crusher can be manufactured at a low cost.

Further, the movable member is reciprocatively approached to the fixed member and retreated therefrom to crush the object because the center portion of the movable member is rotatably mounted on the rod of the hydraulic cylinder, with the lower portion thereof at its supporting point of its rotation. This construction eliminates the need for the use of a complicated eccentric mechanism or a linking mechanism and allows the movable member to approach the fixed member while it is moving downward. Thus, the object thrown into the space between the movable member and the fixed member can be crushed very efficiently.

In particular, in this kind of jaw crusher, objects are liable to enter into gaps between component parts thereof and further, the crusher is used in a severe condition. Thus, unless the crusher has a small number of component parts and a simple construction, troubles are likely to occur. In consideration of the above problem, the crusher has a simple construction. That is, the supporting arm projecting downward from the movable member is rotatably mounted on the frame of the crusher so that the movable member is movable, with the supporting shaft at its supporting point; and the rear side of the movable member is connected with the rod of the hydraulic cylinder. Therefore, the crusher of the present invention has a reduced frequency of failure and the manufacturing and maintenance cost can be reduced greatly.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A crusher to be removably installed on an arm of a hydraulic shovel having a hydraulic source, comprising:

a frame;

a bracket extending from said frame and connected to said arm;

a fixed member provided on said frame;

a movable member having a supporting arm extending downwardly and pivotally connected to said frame at a supporting point such that said movable member confronts the fixed member forming a crushing space between them;

a driving device installed in the frame so as to allow the movable member to approach or retreat from the fixed member;

a plurality of crushing plates installed on each of the fixed member and the movable member to crush an object in said crushing space;

a discharge port provided at a lower end of the frame to discharge crushed pieces of said object, an adjusting plate removably attached between said fixed member and a lowermost crushing plate for adjusting a size of said crushed pieces discharged, the driving device comprising:

a hydraulic cylinder connected to said hydraulic source and provided in a direction substantially perpendicular to said fixed member; and a rod reciprocatedly supported by said hydraulic cylinder and pivotally connected at a connecting end with a central portion of the movable member, said connecting end vertically aligned with said supporting point when said rod extends to a maximum point so as to move said movable member substantially in said direction thereby providing a relatively large traveling distance of said movable member.

2. The crusher according to claim 1, wherein said driving device comprises a control mechanism for detecting a hydraulic pressure on each of extension and retraction sides of said hydraulic cylinder and switching extension and retraction operations of said rod when said hydraulic pressure on the extension or retraction side of said hydraulic cylinder exceeds a predetermined value.

3. The crusher according to claim 1, wherein a plurality of openings is provided in a lattice-like form at an end of an object-introducing opening of the frame.

4. The crusher according to claim 1, wherein a hopper is installed on an upper part of the frame so as to introduce the object through an upper opening of the frame into a space between the fixed member and the movable member.

5. The crusher according to claim 1, wherein a small-diameter passage is provided on a front end of a piston on a rod connection side or on a plunger connecting the front end of the piston and the rod, so that when the piston approaches a stroke end on the extension side thereof, a flow rate of lubricating oil flowing through a lubricating oil entrance/exit formed in the cylinder is reduced through the small-diameter passage to allow the piston to collide a cylinder head with a weak force at the stroke end of the piston.

6. The crusher according to claim 1, wherein an electromagnet is installed on an outer surface of the frame to attract objects thereto by means of a magnetic force.

7. The crusher according to claim 2, wherein the driving device comprises:

a first pressure detection port to which a first hydraulic pressure on a rod side of the hydraulic cylinder is applied;

a second pressure detection port to which a second hydraulic pressure on a piston side of the hydraulic cylinder is applied; and a spring center type selector valve having first and second springs which specify a required value of each of hydraulic pressures on extension and retraction sides of the hydraulic cylinder and being switched when a difference between the first and second hydraulic pressures becomes higher than an urging force of the first or second spring.

* * * * *